US009280959B2

(12) United States Patent
Coheley

(10) Patent No.: US 9,280,959 B2
(45) Date of Patent: Mar. 8, 2016

(54) PRACTICE PAD FOR PERCUSSION INSTRUMENT

(71) Applicant: David M. Coheley, Powder Springs, GA (US)

(72) Inventor: David M. Coheley, Powder Springs, GA (US)

( * ) Notice: Subject to any disclaimer, the term of this patent is extended or adjusted under 35 U.S.C. 154(b) by 0 days.

(21) Appl. No.: 14/506,168

(22) Filed: Oct. 3, 2014

(65) Prior Publication Data

US 2015/0096428 A1 Apr. 9, 2015

Related U.S. Application Data

(60) Provisional application No. 61/887,070, filed on Oct. 4, 2013.

(51) Int. Cl.
*G10D 13/02* (2006.01)

(52) U.S. Cl.
CPC ..... *G10D 13/029* (2013.01)

(58) Field of Classification Search
CPC ... G10D 13/026; G10D 13/02; G10D 13/021; G10D 13/00; G10D 13/029; G10G 5/005; G10G 5/00
USPC ..... 84/411 R, 411 P, 421
See application file for complete search history.

(56) References Cited

U.S. PATENT DOCUMENTS 5,877,440 A * 3/1999 Chaffee et al. ..... 84/411 M
6,063,992 A * 5/2000 Schwagerl ..... 84/411 P
2007/0256537 A1* 11/2007 de los Reyes ..... 84/421

* cited by examiner

*Primary Examiner* — Kimberly Lockett
(74) *Attorney, Agent, or Firm* — Meunier Carlin & Curfman LLC

(57) ABSTRACT

The present invention is directed to an apparatus providing a removable playing surface to a percussion instrument. The apparatus includes a mount assembly for fixing the apparatus to the percussion instrument and a paddle providing a playing surface. The paddle can movable between a playing position over the head of the percussion instrument and in a non-playing position away from the head of the percussion instrument.

20 Claims, 39 Drawing Sheets

128
126
168
170
172
821

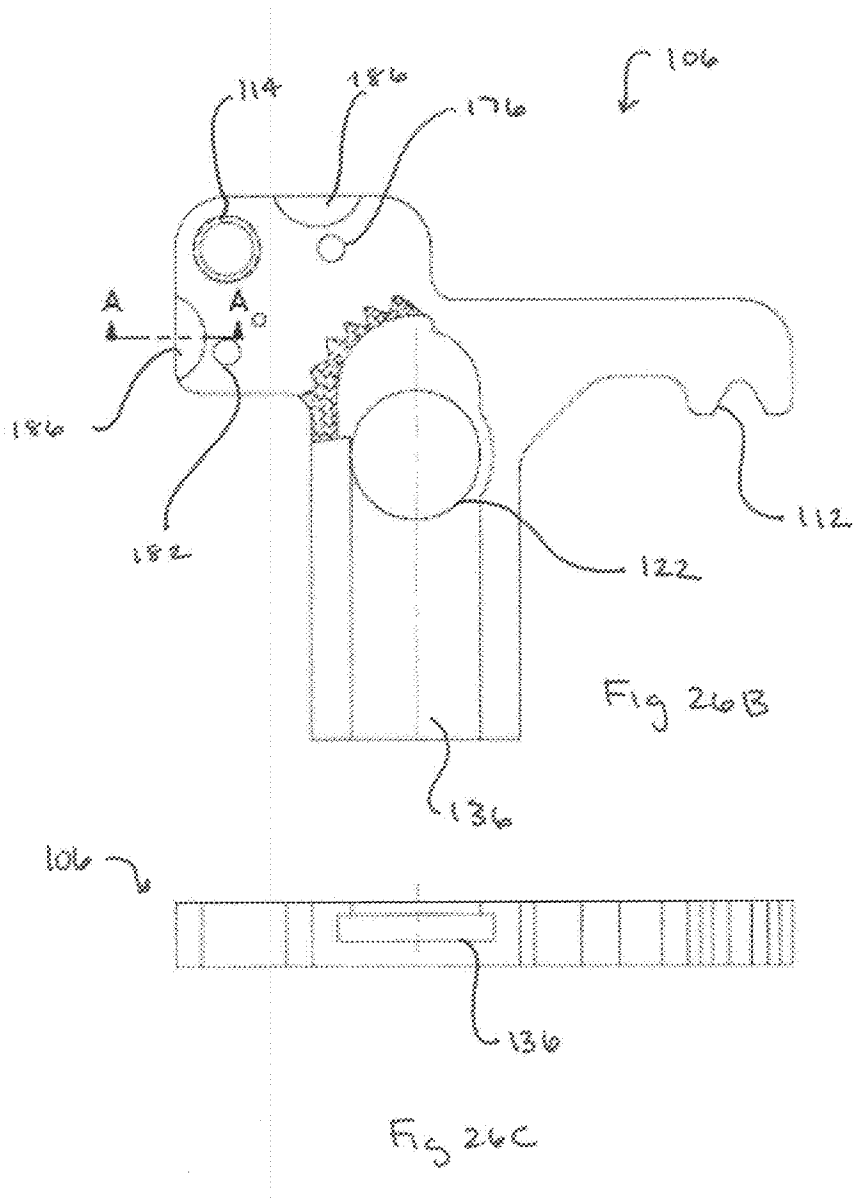
Fig 24B
Fig 24C
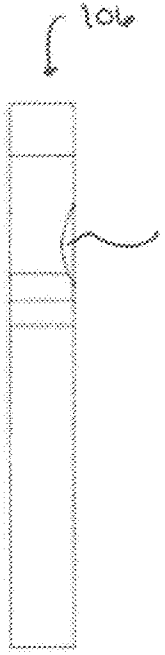
Fig 24A

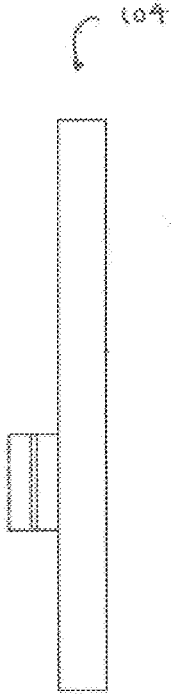
FIG 29D
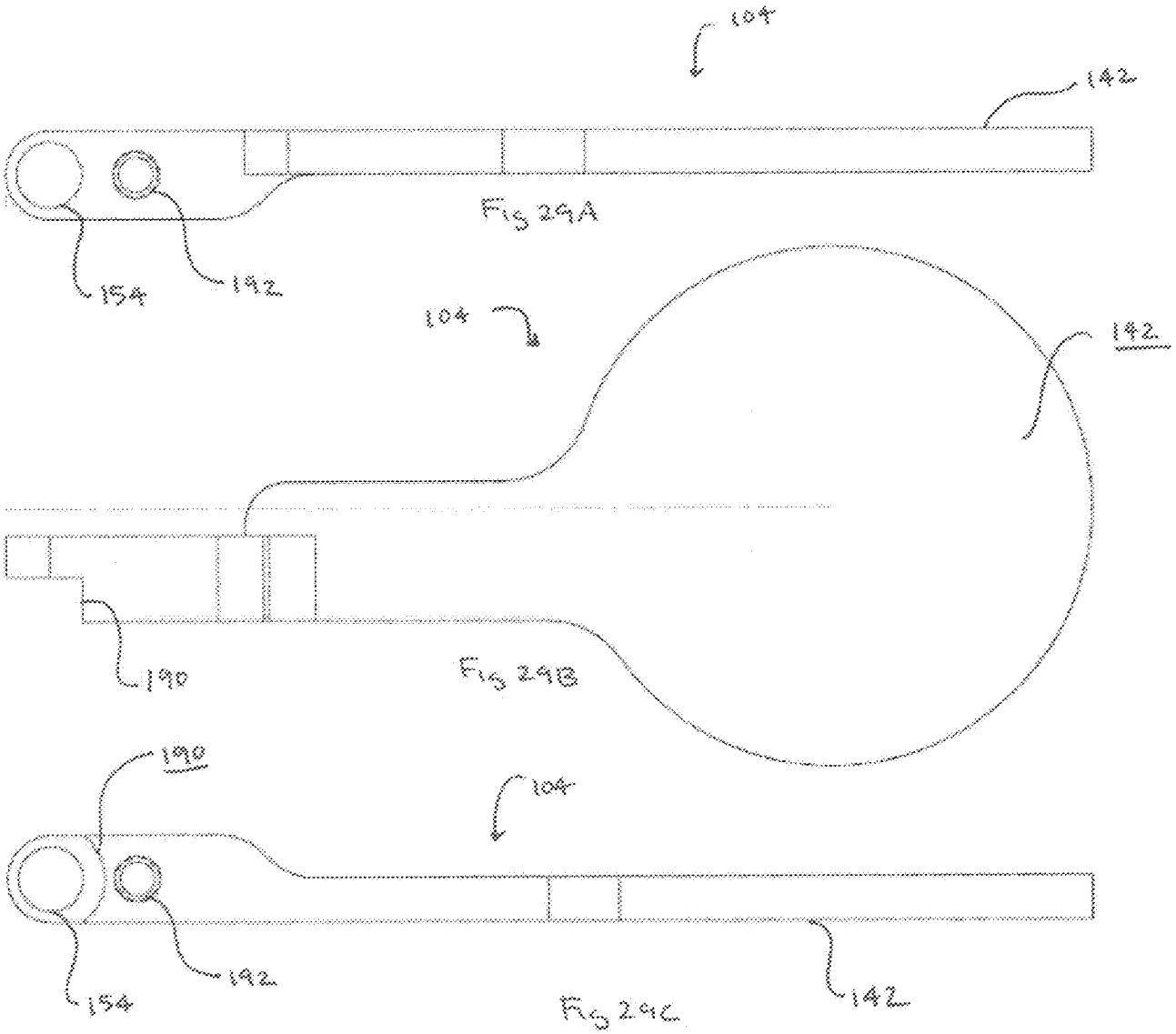
FIG 29A
FIG 29B
FIG 29C

PRACTICE PAD FOR PERCUSSION INSTRUMENT

CROSS REFERENCE TO RELATED APPLICATIONS

This application claims the benefit of priority to U.S. Provisional Application No. 61/887,070, filed Oct. 4, 2013, which is incorporated herein by reference in its entirety.

TECHNICAL FIELD

This invention relates to a drum practice pad. More particularly, a practice pad that can be removably attached to the percussion instrument. The location of the practice pad can be adjusted to simulate the playing surface of an actual drum.

BACKGROUND

Percussion practice pads are used by musicians to simulate a playing experience. Practice pads are frequently used when warming up/practicing before a performance where noise concerns prevent practice on actual percussion instrument. Typically designed to be supported on a flat surface, conventional practice pads are not portable. Other practice pads include pad surfaces attached to stands/mounts, simulating a drum set. As such, neither individual practice pads nor mounted practice pads are portable or otherwise associated with an actual percussion instrument. That is, conventional practice pads must be supported by a stand/mount or tabletop surface. Thus, there remains a need for a practice pad that is both portable and easily associated and/or affixed to a corresponding percussion instrument.

SUMMARY

Presented are systems and methods for providing a playing surface to a percussion instrument. An aspect of the present disclosure is directed to an apparatus providing a removable playing surface. The apparatus may include a mount assembly for fixing the apparatus to the percussion instrument. The apparatus may further include a paddle providing the playing surface. The paddle may be coupled to the mount such that the paddle is movable between a playing position over the head of the percussion instrument and in a non-playing position away from the head of the percussion instrument.

The details of one or more embodiments of the invention are set forth in the accompanying drawings and the description below. Other features, objects, and advantages of the invention will be apparent from the description and drawings, and from the claims.

DESCRIPTION OF DRAWINGS

The device is explained in even greater detail in the following drawings. The drawings are merely examples to illustrate the structure of preferred devices and certain features that may be used singularly or in combination with other features. The invention should not be limited to the examples shown.

FIG. 16A is a side view of the example handle of FIG. 15;

FIG. 16B is a back view of the example handle of FIG. 15;

FIG. 16C is a side view of the example handle of FIG. 15;

FIG. 16D is a front view of the example handle of FIG. 15;

FIG. 26A is a side view of an example upper clamp member;

FIG. 26B is a front view of an example upper clamp member;

FIG. 26C is an end view of an example upper clamp member;

FIG. 29A is a side view of the example paddle of FIG. 28;

FIG. 29B is a top view of the example paddle of FIG. 28;

FIG. 29C is a side view of the example paddle of FIG. 28;

FIG. 29D is an end view of the example paddle of FIG. 28;

Like reference symbols in the various drawings indicate like elements.

DETAILED DESCRIPTION

Figure 1:
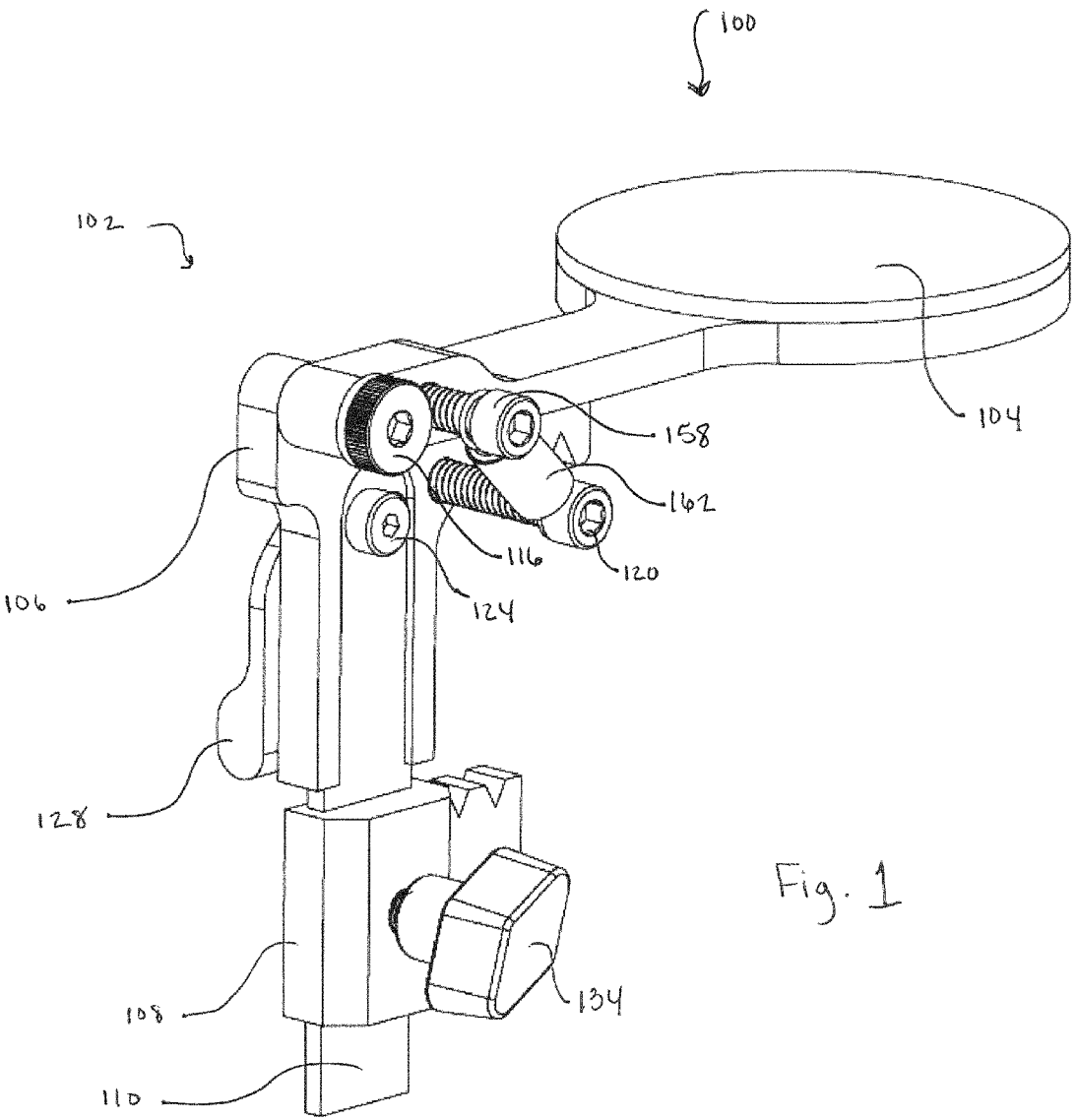
FIG. 1 is a perspective view of an example apparatus.

Certain terminology is used in the following description for convenience only and is not limiting. The words "right", "left", "lower", and "upper" designate direction in the drawings to which reference is made. The words "inner", "outer" refer to directions toward and away from, respectively, the geometric center of the described feature or device. The words "distal" and "proximal" refer to directions taken in context of the item described and, with regard to the apparatus herein described, are typically based on the perspective of the performer using such apparatus. The terminology includes the above-listed words, derivatives thereof, and words of similar import.

Certain examples of the invention will now be described with reference to the drawings. In general, such examples relate to the use of a drum practice pad that can be removably attached to a percussion instrument. Example percussion instruments include marching multi-tenor drums, marching bass drums, marching snare drums, concert snare drums, and any other stationary or portable membranophone (instruments producing sound via vibration of stretched membrane) and/or idiophone (instruments producing sound via vibration of the instrument without the use of strings or membrane) known in the art.

Figure 2:
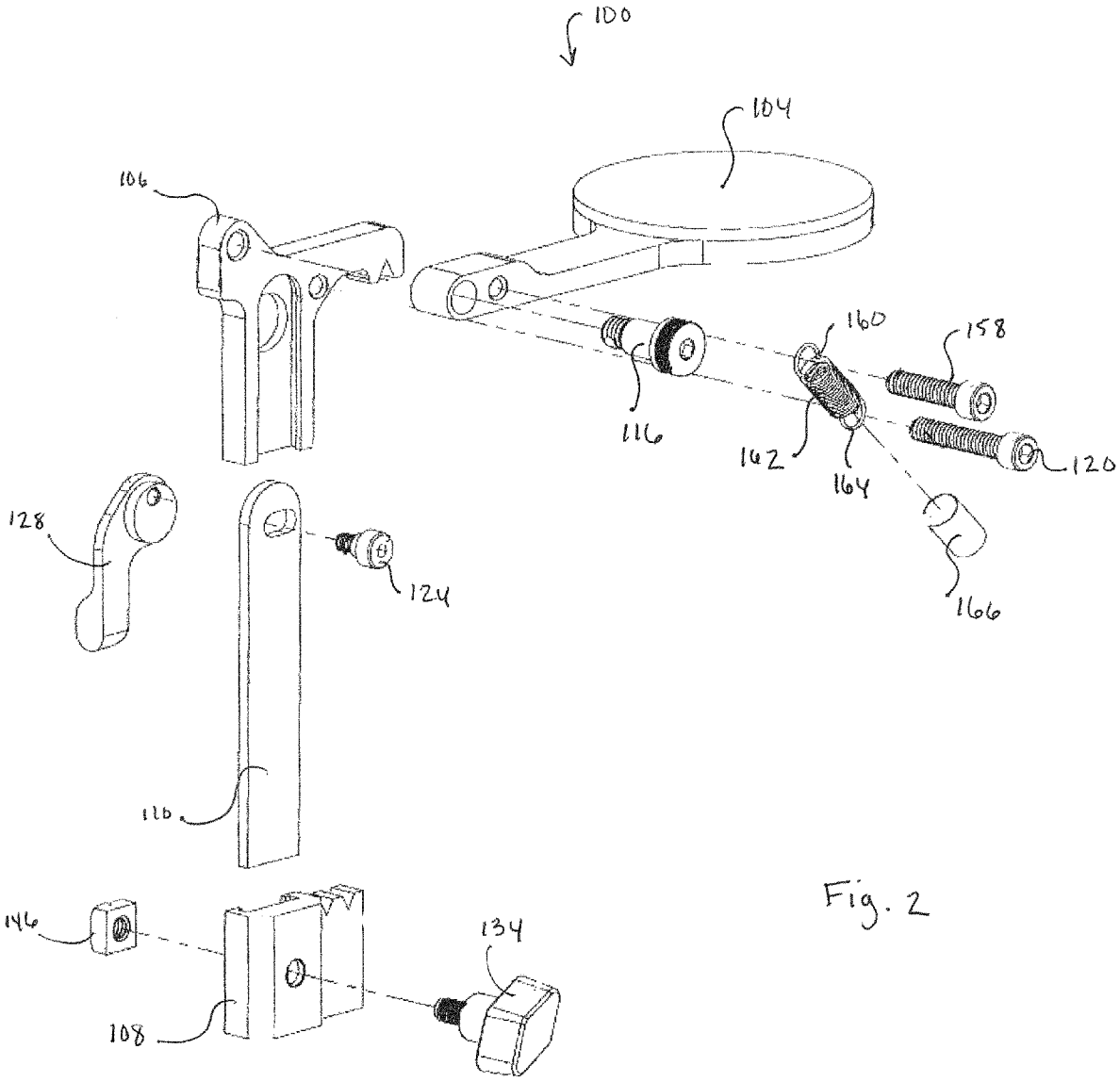
FIG. 2 is an exploded perspective view of an example apparatus.

FIG. 1 provides a perspective view of an example apparatus 100. FIG. 2 provides an exploded perspective view of the example apparatus 100. The apparatus 100 can include a mount assembly 102 and a paddle 104.

Figure 21:
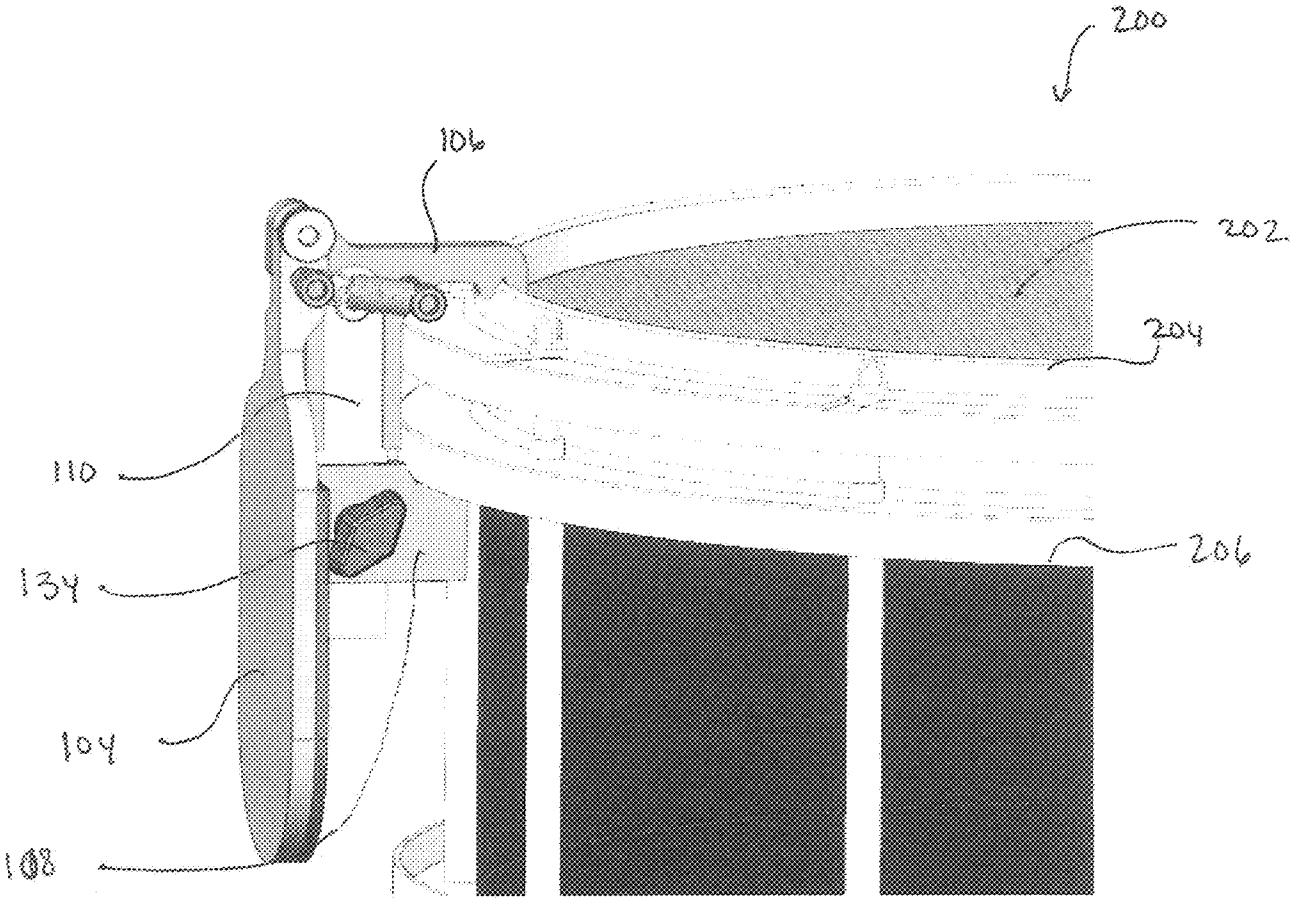
FIG. 21 is a perspective view of an example apparatus coupled to a percussion instrument.
Figure 22:
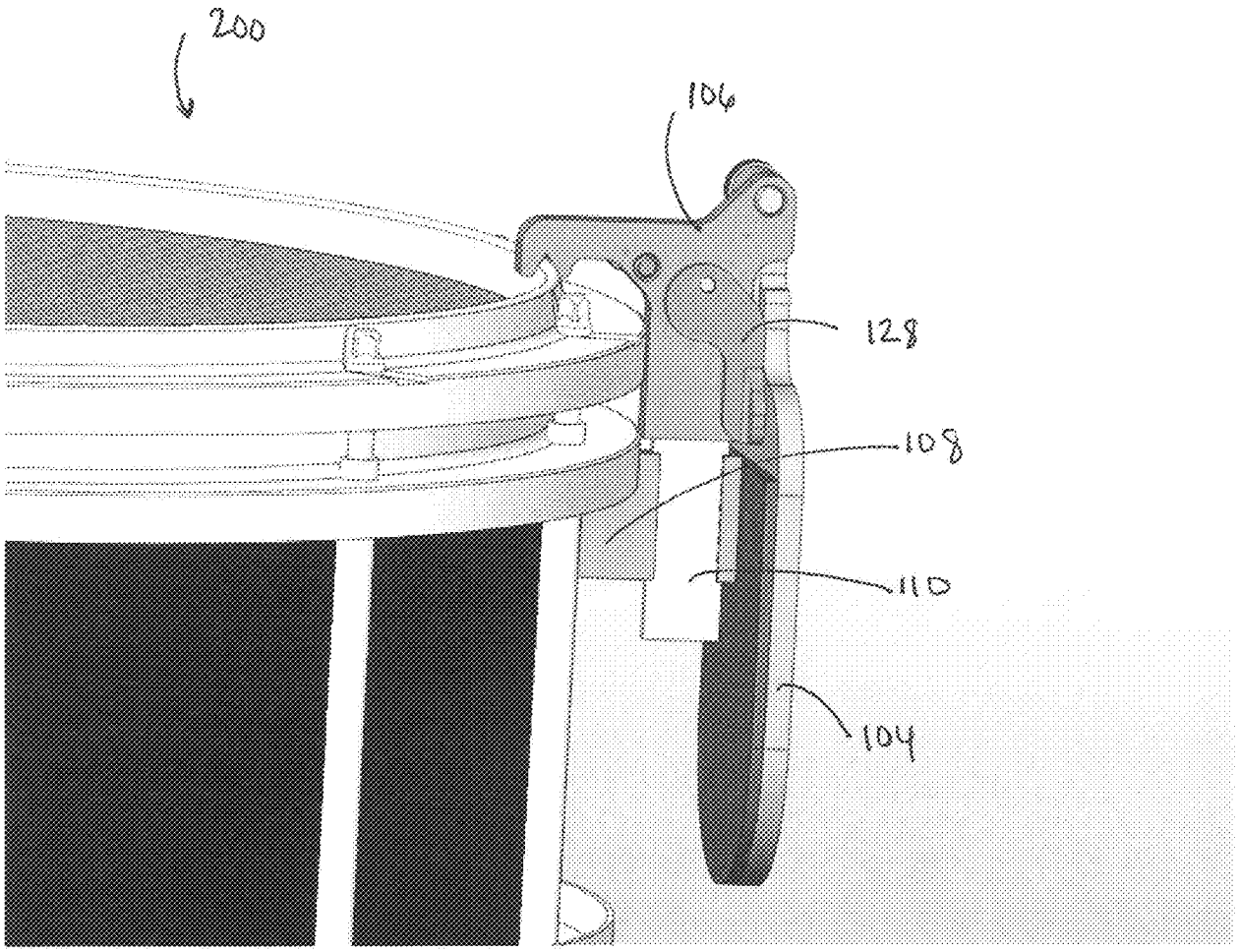
FIG. 22 is a perspective view of an example apparatus coupled to a percussion instrument.

The location of the practice pad/apparatus 100 can be adjusted to simulate the playing surface of an actual drum. The mount assembly 102 can be used to fix the apparatus 100 to the percussion instrument 200 (not shown in FIG. 1). As will be explained in more detail below, the paddle 104 can be coupled to the mount assembly 102 such that the paddle 104 is movable between a playing position over the head 202 of the percussion instrument 200, as illustrated in FIG. 17-20, and in a non-playing position away from the head 202 of the percussion instrument 200, as illustrated in FIG. 21-22.

Figure 3:
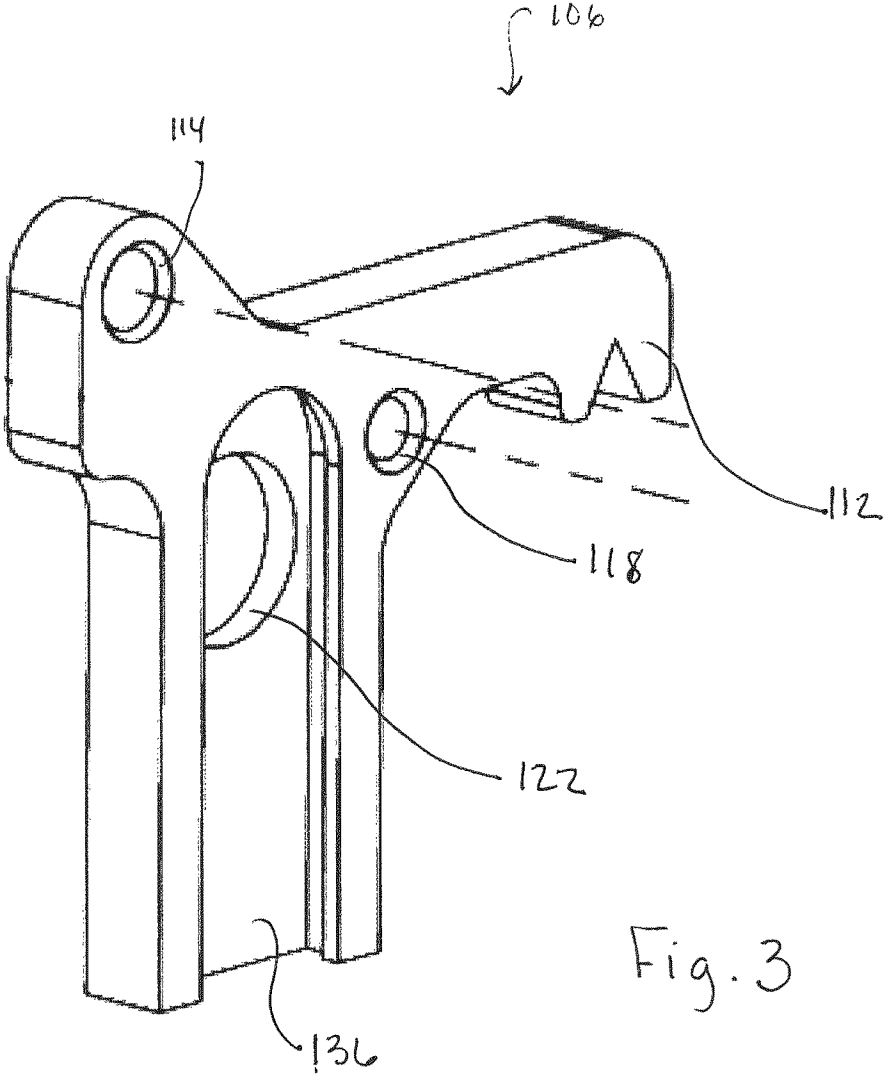
FIG. 3 is a perspective view of an example upper clamp member.
Figure 4B:
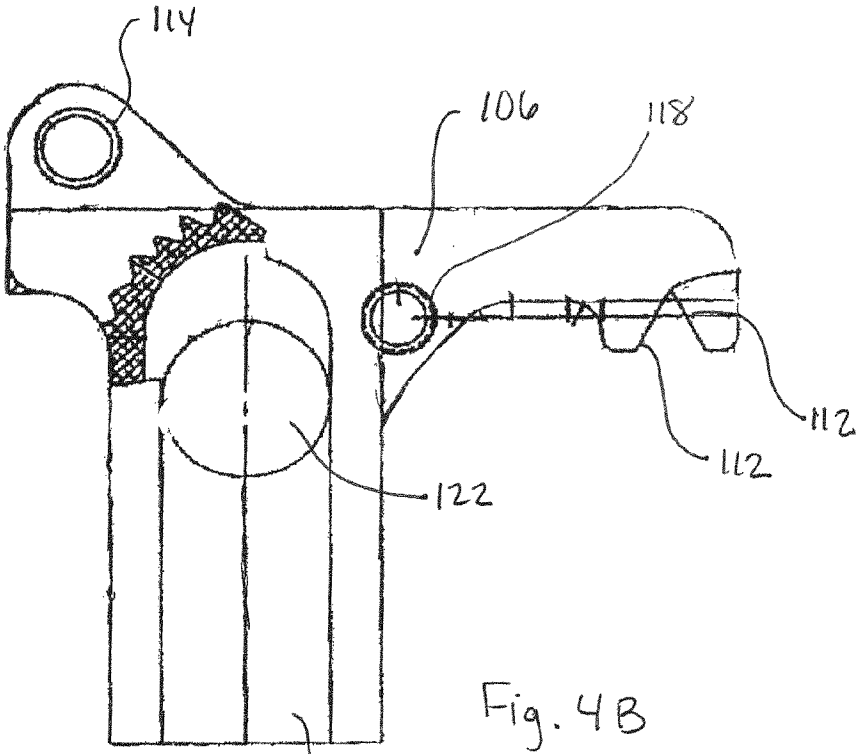
FIG. 4B is a front view of an example upper clamp member.
Figure 4C:
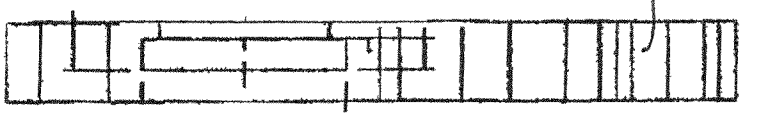
FIG. 4C is an end view of an example upper clamp member.
Figure 4A:
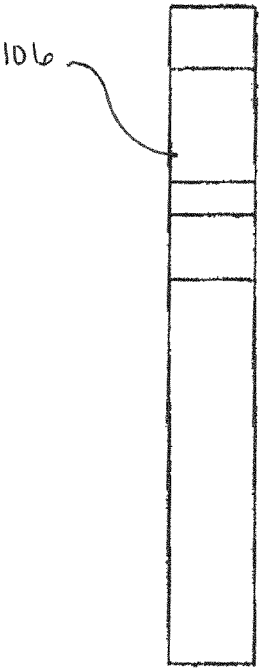
FIG. 4A is a side view of an example upper clamp member.

The mount assembly 102 can include an upper clamp member 106, a lower clamp member 108, and a draw bar 110 coupled to the upper clamp member 106 and the lower clamp member 108 such that the spacing/distance between the upper clamp member 106 and the lower clamp member 108 can be adjusted. FIG. 3 provides a perspective view of an example upper clamp member 106. FIGS. 4A-4C provide side and top views of the upper clamp member 106. As illustrated, the upper clamp member 106 can include an upper engagement portion 112 for engaging the percussion instrument 200. The upper engagement portion 112 can include a groove or recess sized and configured to engage a corresponding portion 204 of the percussion instrument 200. For example, the upper engagement portion 112 can include a recess sized and configured to engage an upper rim portion of the percussion instrument 200. The upper clamp member 106 can include a paddle pin bore 114 sized and configured to engage a corresponding paddle pin 116. The upper clamp member 106 can also include a spring pin bore 118 sized and configured to engage a corresponding spring pin 120. The upper clamp member 106 can also include a handle bore 122 sized and configured to engage a corresponding handle pin 124 and/or rotation portion 126 of the handle 128.

Figure 5B:
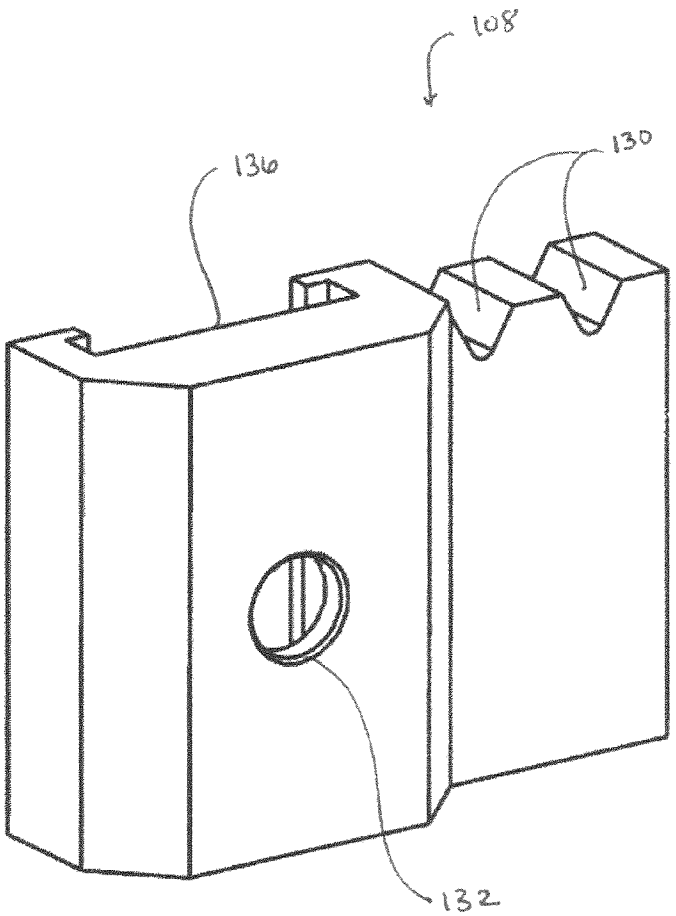
FIG. 5B is a back perspective view of an example lower clamp member.
Figure 5A:
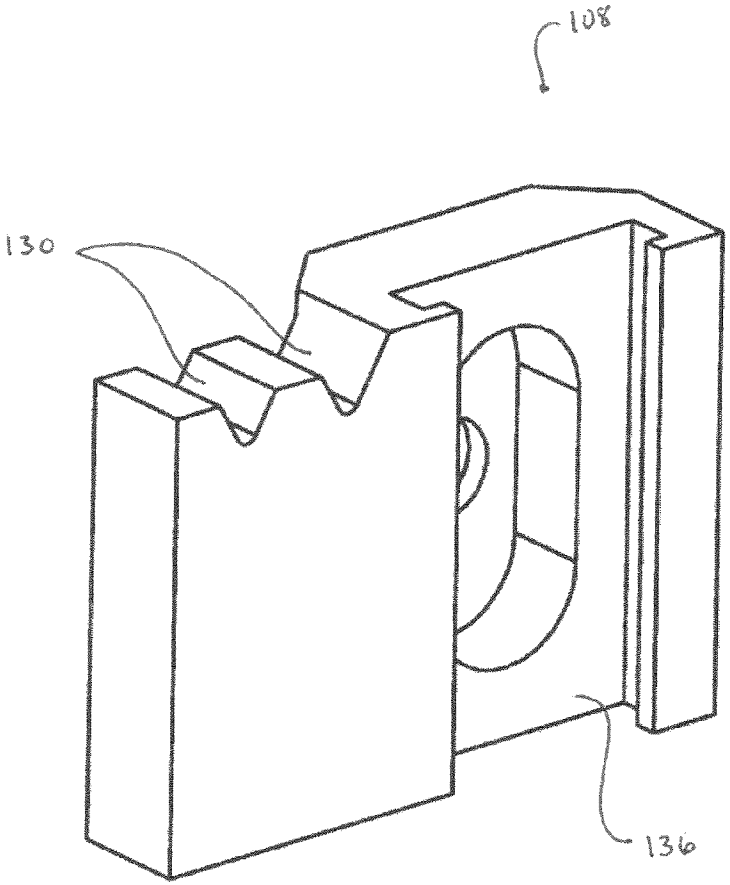
FIG. 5A is a front perspective view of an example lower clamp member.
Figure 6A:
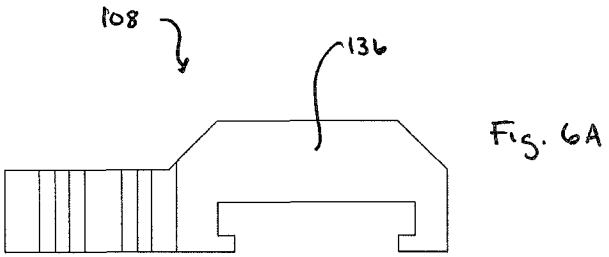
FIG. 6A is a top view of an example lower clamp member.
Figure 6B:
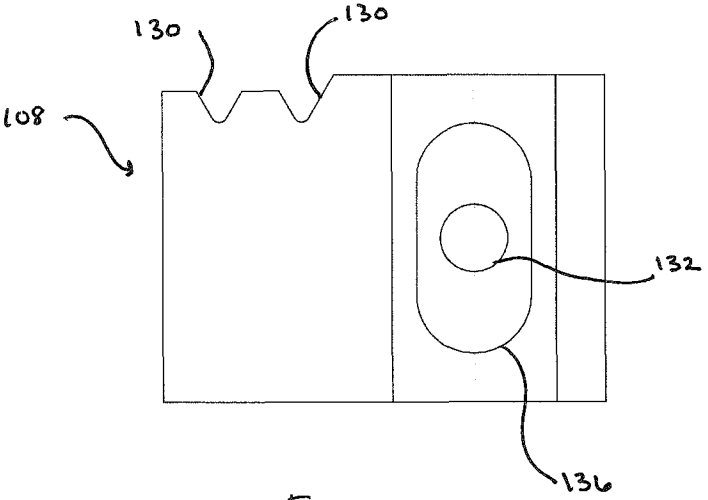
FIG. 6B is a front view of an example lower clamp member.
Figure 6C:
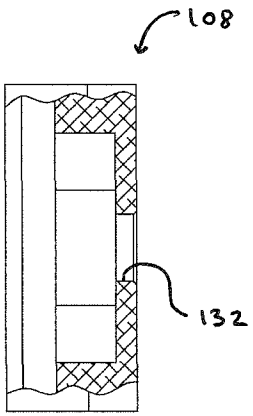
FIG. 6C is a side view of an example lower clamp member.
Figure 6D:
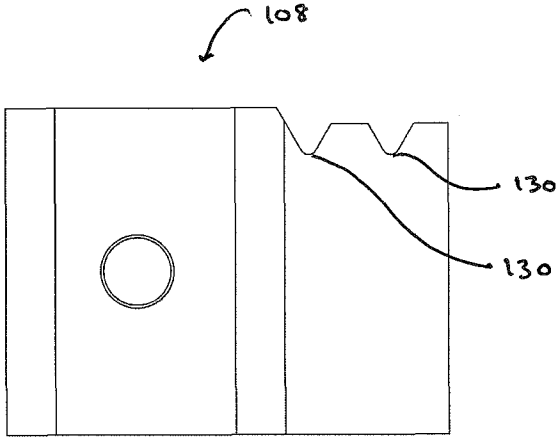
FIG. 6D is a back view of an example lower clamp member.

FIGS. 5A and 5B provides a perspective views of an example lower clamp member 108. FIGS. 6A-D provide side, front and back views of the lower clamp member 108. The lower clamp member 108 can include a lower engagement portion 130 for engaging the percussion instrument 200. The lower engagement portion 130 can include a groove or recess sized and configured to engage a corresponding portion 206 of the percussion instrument 200. For example, the lower engagement portion 130 can include a recess sized and configured to engage a lower rim portion of the percussion instrument 200. The lower clamp member 108 can include a locking member bore 132 sized and configured to engage a corresponding locking member 134.

Figure 7C:
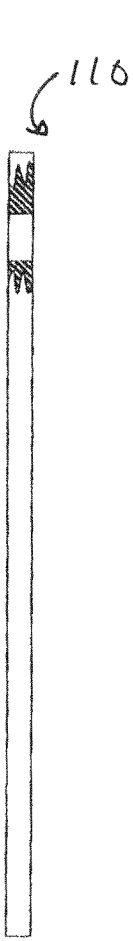
FIG. 7C is a side view of an example draw bar.
Figure 7B:
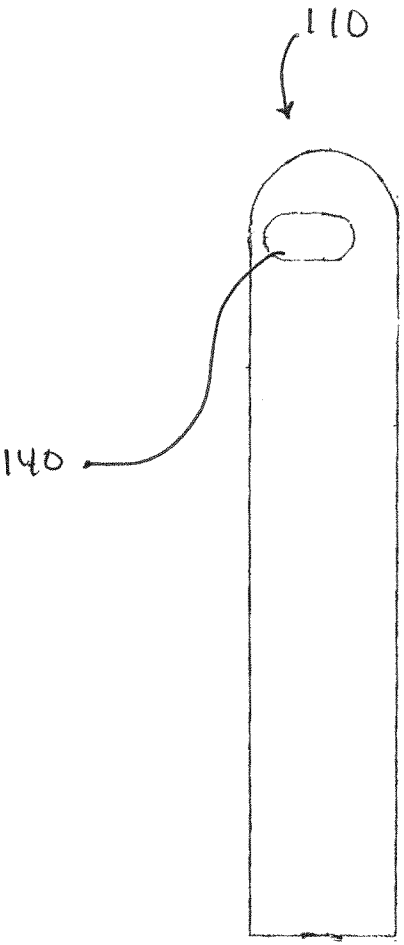
FIG. 7B is a front view of an example draw bar.
Figure 7A:
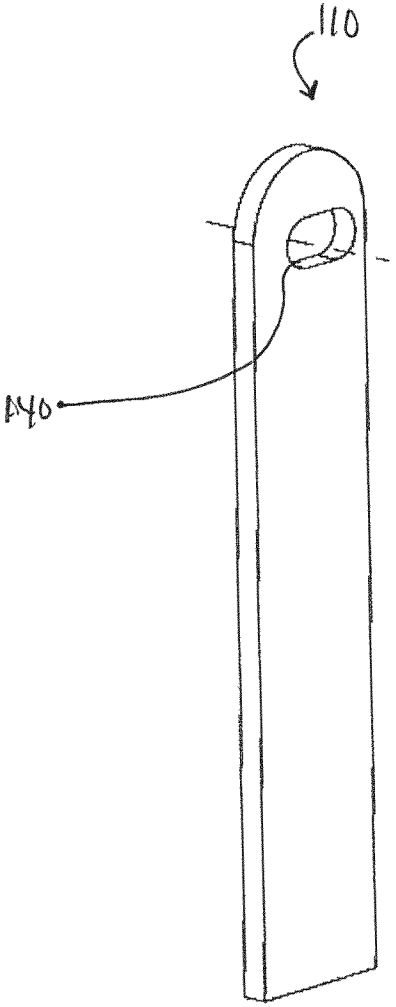
FIG. 7A is a perspective view of an example draw bar.

FIG. 7A provides a perspective view of an example draw bar 110. FIGS. 7B-C provide front and side views of the draw bar 110. As outlined above, the draw bar 110 can be movably coupled to the upper clamp member 106 and the lower clamp member 108 such that the spacing/distance between the upper clamp member 106 and the lower clamp member 108 can be adjusted along the draw bar 110. For example, as illustrated in FIGS. 3-6, the upper clamp member 106 and the lower clamp member 108 can include a recess 136 for receiving the draw bar 110. The draw bar 110 and the recess 136 can be sized and configured such that the draw bar 110 moves freely within the recess 136. The location of the draw bar 110 can be fixed with respect to the mount assembly 102 using a locking member 134. For example, contact between the locking member 134 and the draw bar 110 can be used to prevent movement between the mount assembly 102 and the draw bar 110. In another example (not shown), the draw bar 110 can include a locking member bore sized and configured to engage a corresponding locking member 134. The draw bar 110 can also include a handle bore 140 sized and configured to engage a corresponding handle pin 124. The handle bore 140 can include an elongated slot extending in a direction perpendicular to the longitudinal axis of the draw bar 110. The elongated slot-shaped handle bore 140 permits the handle pin 124 to rotate while in a locked position. The handle pin 124 mates the handle 128 and upper clamp member 106 with the draw bar 110 via the handle bore 122 and handle bore 140. For example, the handle pin 124 can extend from the handle 128 and into and/or through the upper clamp member 106 (at handle bore 122) and the draw bar 110 (at handle bore 140). In an example apparatus 100, the handle pin 124 can include a shoulder screw.

Figure 8B:
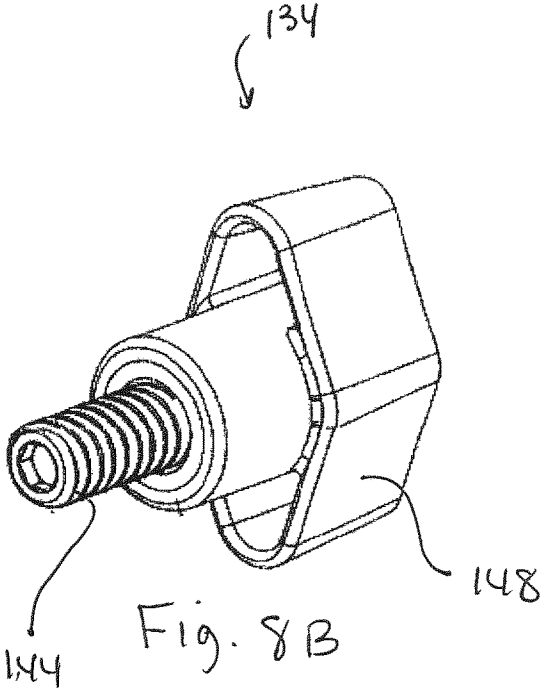
FIG. 8B is a perspective view of an example locking member.
Figure 8A:
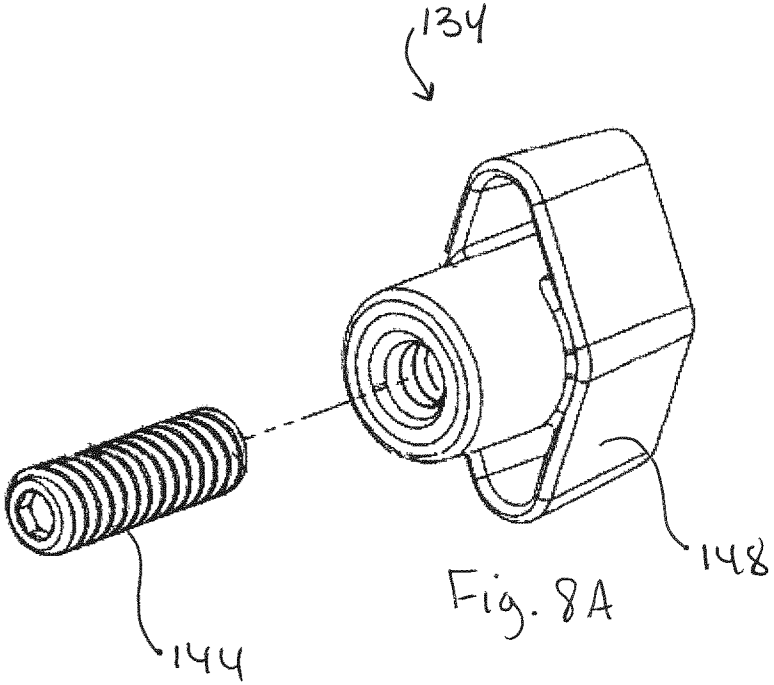
FIG. 8A is an exploded view of an example locking member.

A locking member 134 can be used to fix the position of the draw bar 110 with respect to at least one of the upper clamp member 106 and the lower clamp member 108. FIG. 8A provides an exploded view of an example locking member 134. FIG. 8B provides a perspective view of the locking member 134. The locking member 134 can include an elongated member 144 sized and configured to engage the locking member bore 132 of the lower clamp member 108.

In an example apparatus 100, the elongated member 144 of the locking member 134 extends through the lower clamp member 108 and contacts the draw bar 110. Pressure and/or contact between the elongated member 144 and the draw bar 110 fix the location of the lower clamp member 108 with respect to the mount assembly 102/draw bar 110. In another example (not shown), the elongated member 144 of the locking member 134 is sized and configured to extend through the lower clamp member 108, engage a locking member bore of the draw bar 110, and a locking nut 146 opposite the lower clamp member 108. As illustrated in FIG. 2, the locking nut 146 can be sized and configured to engage the elongated member 144, and fix the longitudinal position of the elongated member 144 with respect to the draw bar 110 and the upper and/or lower clamp members 106, 108. An example locking nut 146 can include a square locking nut. In a further example (not shown), the elongated member 144 of the locking member 134 is sized and configured to engage a locking member bore of the upper clamp member 106.

The locking member 134 can also include a grip portion 148 coupled to an end of the elongated member 144. The grip portion 148 can be used to manipulate the axial and/or rotational orientation/direction of the elongated member 144. For example, the user can rotate the grip portion 148 and thereby cause a corresponding rotation of the elongated member 144. In an example apparatus 100, the elongated member 144 comprises a socket set screw. In an example apparatus 100, the grip portion 148 comprises a thumb screw.

Figure 9A:
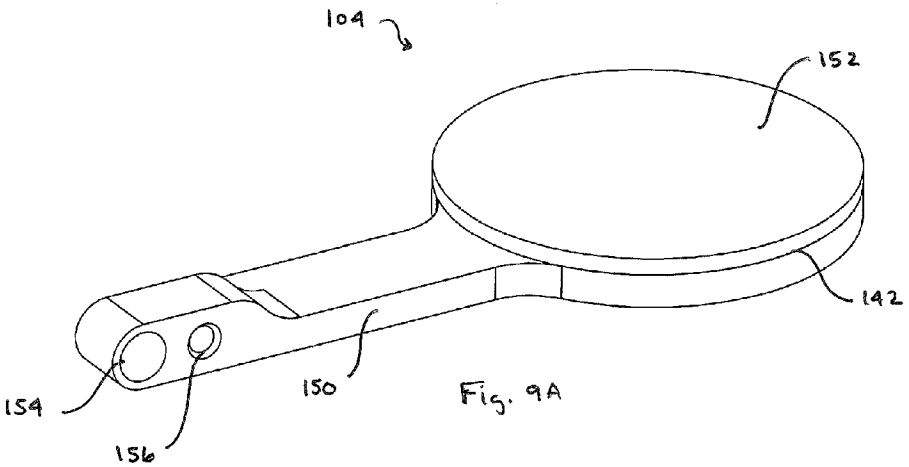
FIG. 9A is a perspective view of an example paddle.
Figure 9B:
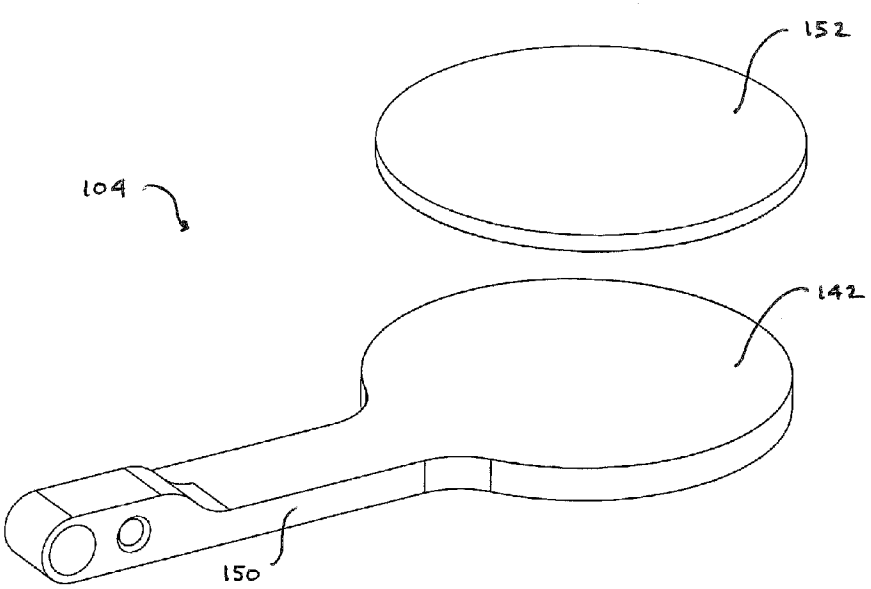
FIG. 9B is an exploded view of an example paddle.
Figure 10C:
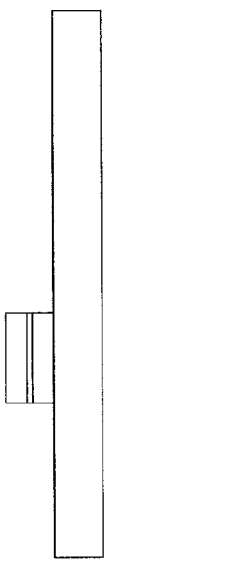
FIG. 10C is a side view of the example paddle of FIG. 9.
Figure 10A:
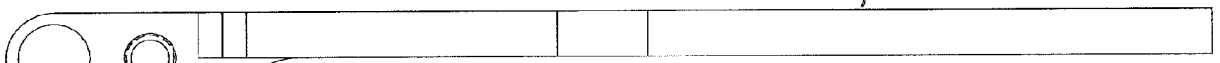
FIG. 10A is a side view of the example paddle of FIG. 9.
Figure 10B:
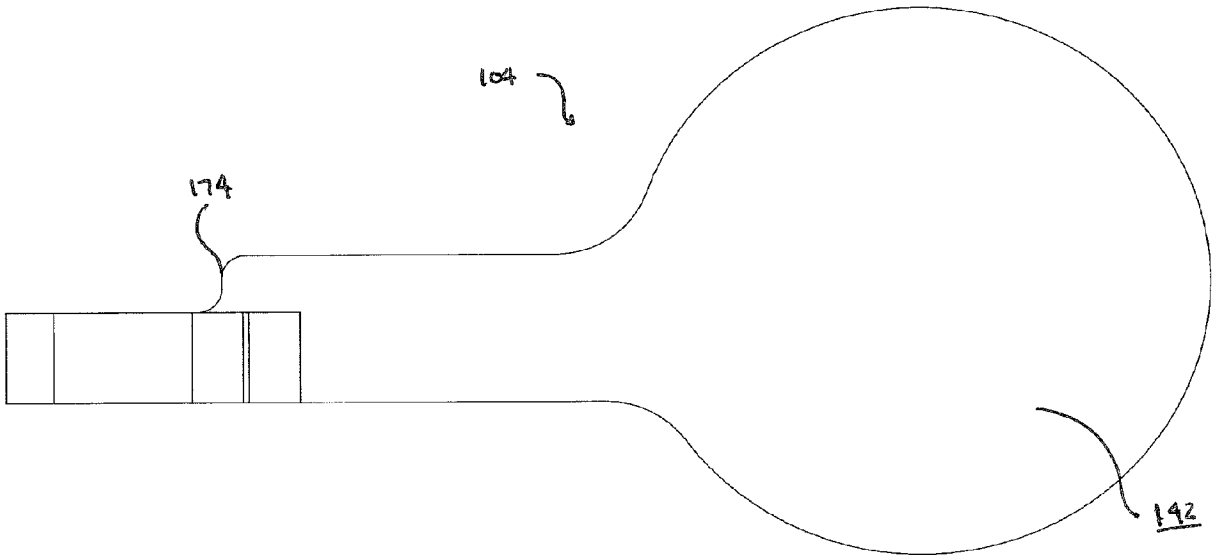
FIG. 10B is a top view of the example paddle of FIG. 9.

As outlined above, the apparatus 100 includes a mount assembly 102 and a paddle 104. The paddle 104 can include a playing surface 142 and a paddle handle 150. FIG. 9A provides a perspective view of an example paddle 104. FIG. 9B provides an exploded view of an example paddle 104. The paddle 104 can be sized and configured to cover the entire playing surface and/or head 202 of the percussion instrument 200. In another example, the noise-dampening pad 152 can be sized and configured to cover a portion of the playing surface and/or head 202 of the percussion instrument 200. A noise-dampening pad 152 can be affixed to at least a portion of the playing surface 142. FIGS. 10A-C provide top and side views of an example paddle 104. As illustrated in the figures, the playing surface 142 can define a circular shape. The paddle handle 150 can extend from the playing surface 142. The paddle handle 150 can include a paddle pin bore 154 sized and configured to engage a corresponding paddle pin 116. The paddle 104 can be pivotably coupled to the mount assembly 102 at the paddle pin 116. For example, the paddle pin 116 can couple the paddle 104 to the upper clamp member 106. An example paddle pin 116 can include a self-locking shoulder screw. The paddle handle 150 can also include a spring pin bore 156 sized and configured to engage a corresponding pin 158 coupled to the second end 160 of the spring 162.

Figure 11B:
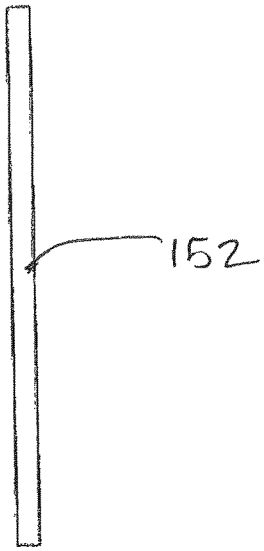
FIG. 11B is a side view of the example pad of FIG. 9.
Figure 11A:
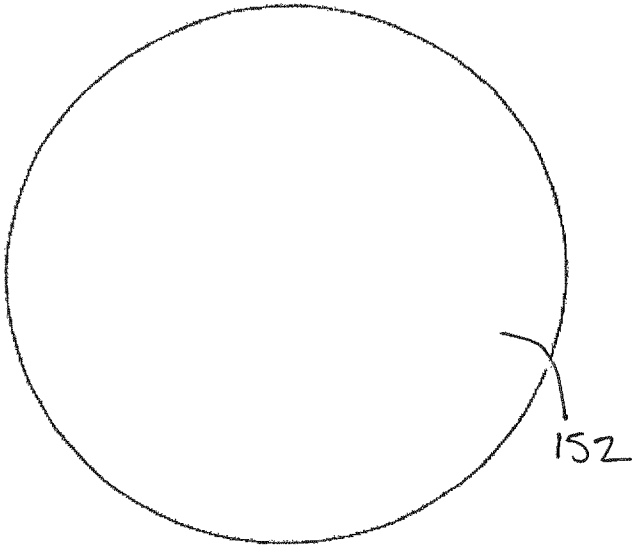
FIG. 11A is a top view of the example pad of FIG. 9.

FIGS. 11A and B provide a top and side view of an example noise-dampening pad 152. The noise-dampening pad 152 can be affixed to at least a portion of the playing surface 142. The noise-dampening pad 152 can be constructed from a material designed to dampening the sound of the user striking the paddle 104. For example, the noise-dampening pad 152 can be constructed of rubber or any other appropriate noise-dampening material known in the art. An example noise-dampening pad 152 can be sized and configured to cover the entire top surface of the playing surface 142. In another example, the noise-dampening pad 152 can be sized and configured to cover a portion of the top surface of the playing surface 142. In a further example (not shown), the noise-dampening pad 152 can be constructed similar to a sleeve and can cover at least a portion of the top and bottom surfaces of the playing surface 142. As illustrated in FIGS. 11A-B, the noise-dampening pad 152 can define a circular shape or any other shape corresponding to the playing surface 142.

Figure 12B:
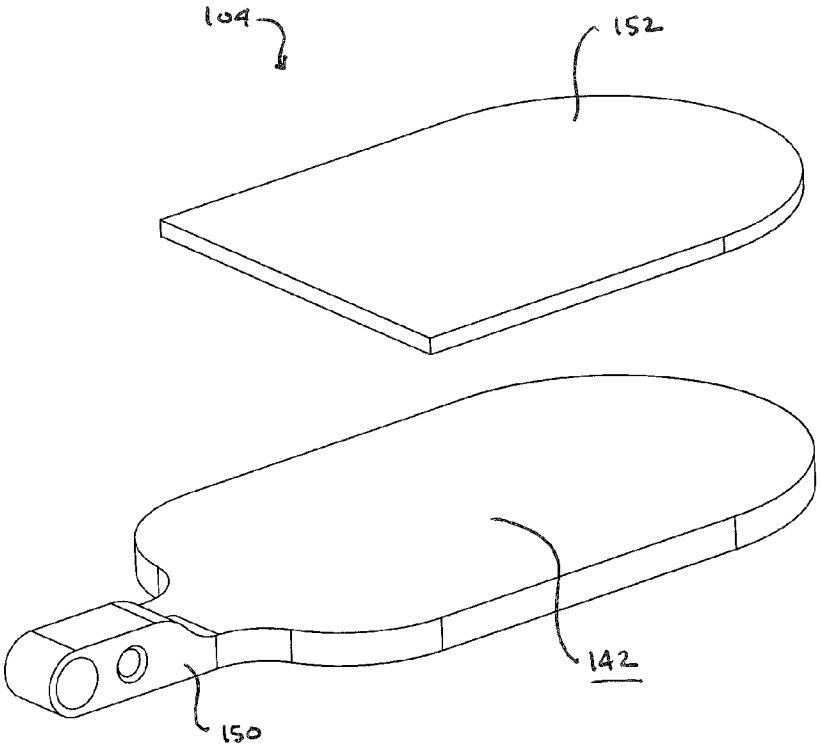
FIG. 12B is an exploded view of an example paddle.
Figure 12A:
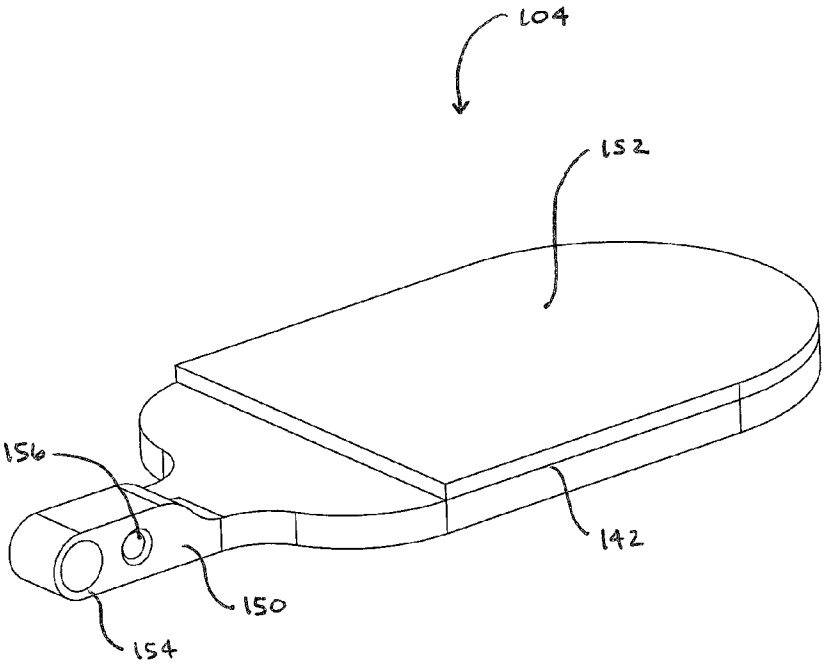
FIG. 12A is a perspective view of an example paddle.
Figure 13C:
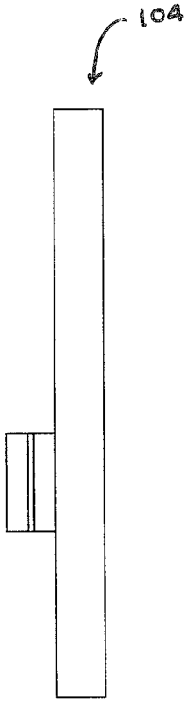
FIG. 13C is a side view of the example paddle of FIG. 12.
Figure 13A:
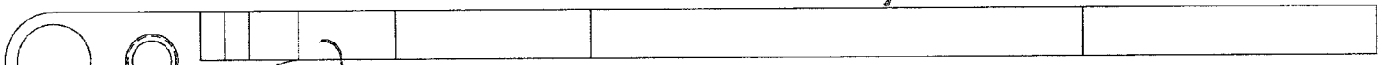
FIG. 13A is a side view of the example paddle of FIG. 12.
Figure 13B:
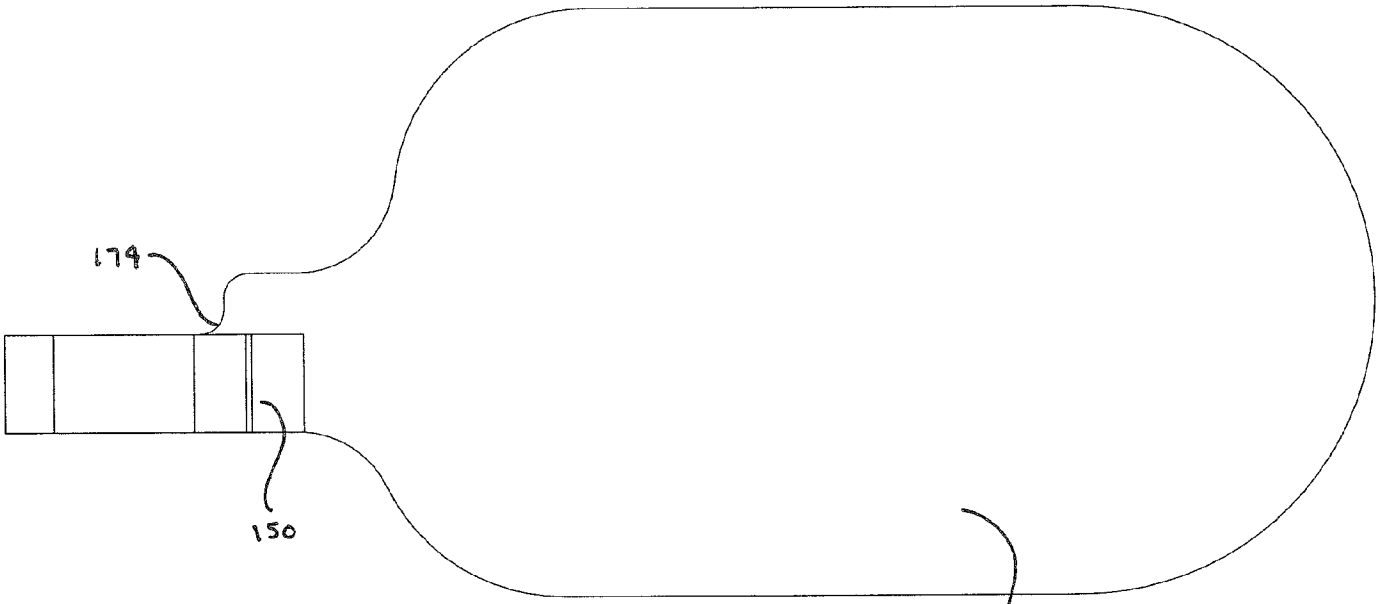
FIG. 13B is a top view of the example paddle of FIG. 12.
Figure 14B:
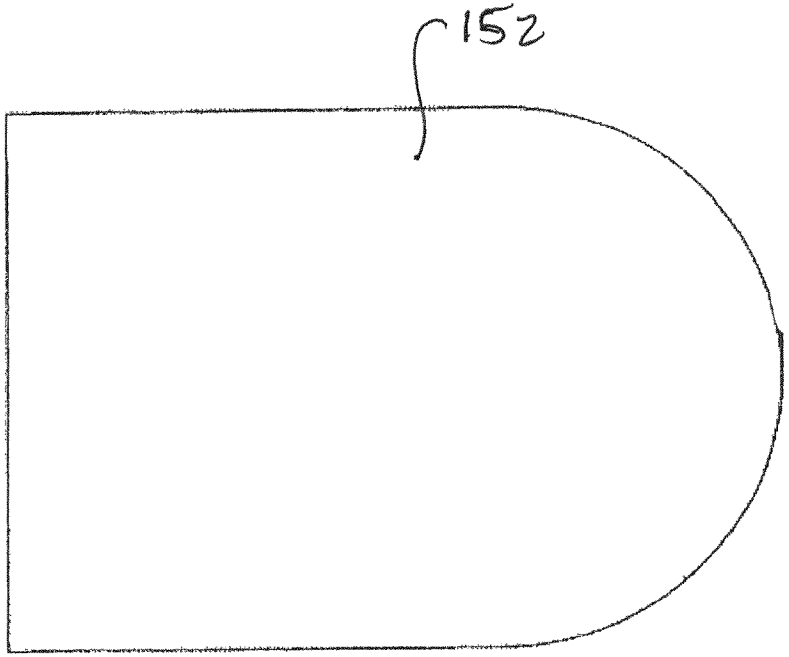
FIG. 14B is a top view of the example pad of FIG. 12.
Figure 14A:
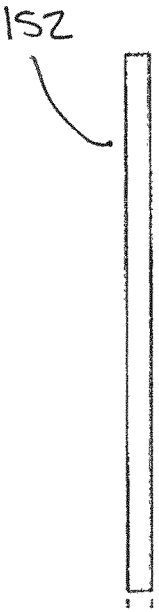
FIG. 14A is a side view of the example pad of FIG. 12.

FIG. 12A provides a perspective view of another example paddle 104. FIG. 12B provides an exploded view of the other example paddle 104. FIGS. 13A-C provide top and side views of the example paddle 104. As illustrated in the figures, the playing surface 142 can define an elongated shape with rounded corners. It is further contemplated that the playing surface 142 can define a square, rectangular, oval or any other regular or irregular shape. Likewise, the noise-dampening pad 152 (as illustrated in FIGS. 12B and 14A-B) can define an elongated shape corresponding to the playing surface 142 of the paddle 104. It is further contemplated, that the noise-dampening pad 152 can define a circular, square, rectangular, oval or any other regular or irregular shape.

In an example apparatus 100, the paddle 104 is spring-loaded to the mount assembly 102. The apparatus 100 can include a spring 162 having a first end 164 coupled to the mount assembly 102 and a second end 160 coupled to the paddle 104. For example, the first end 164 can be coupled to a pin 120 associated with the mount assembly 102 (e.g., the upper clamp member 106) and the second end 160 can be coupled to a pin 158 associated with the paddle 104. In an example, the pin 120 and pin 158 can comprise a socket head cap screw. The spring 162 can also include a spring guard 166 sized and configured to enclose the circumference of the spring 162. For example, the spring guard 166 can comprise a heat shrink material. The paddle 104 can be spring-loaded to default to a playing position. In another example, the paddle 104 can be spring-loaded to default to a non-playing position.

Figure 15B:
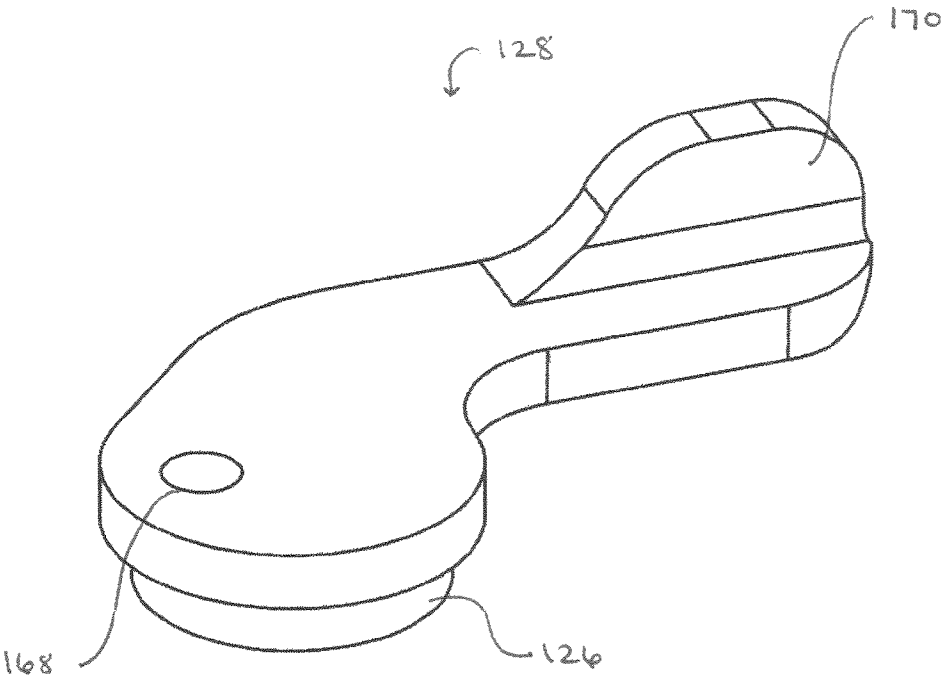
FIG. 15B is a perspective view of an example handle.
Figure 15A:
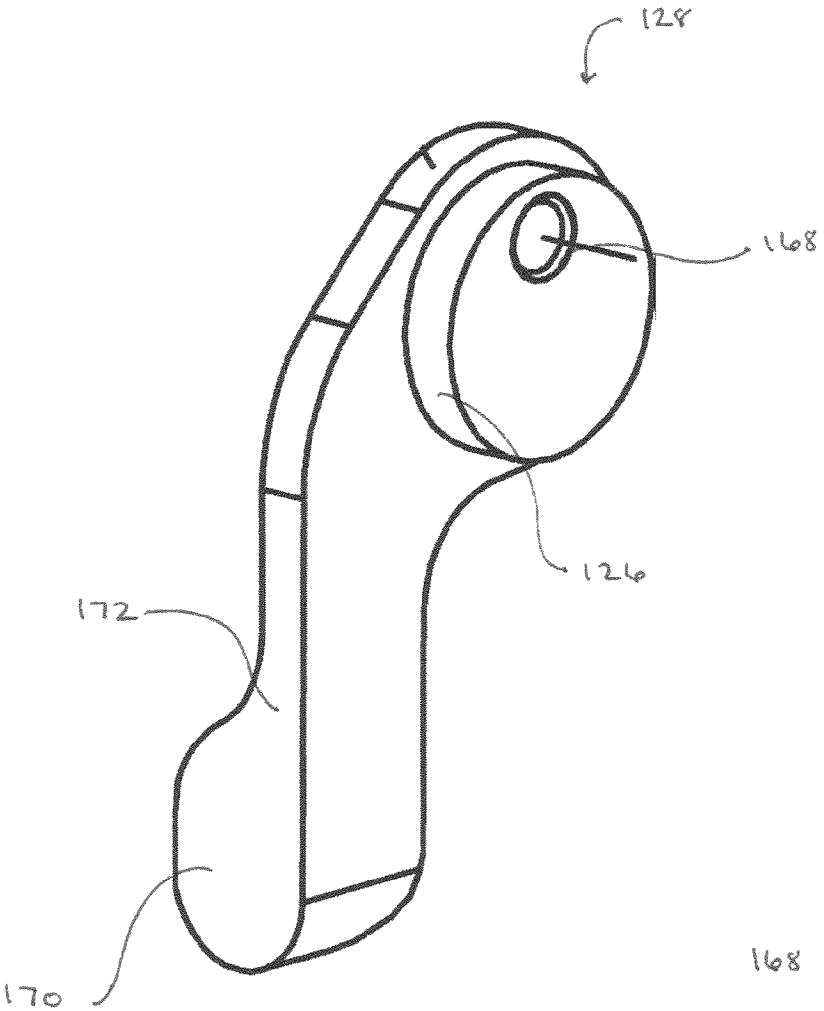
FIG. 15A is a perspective view of an example handle.
Figures 14A, 14B, 14C, 14D:
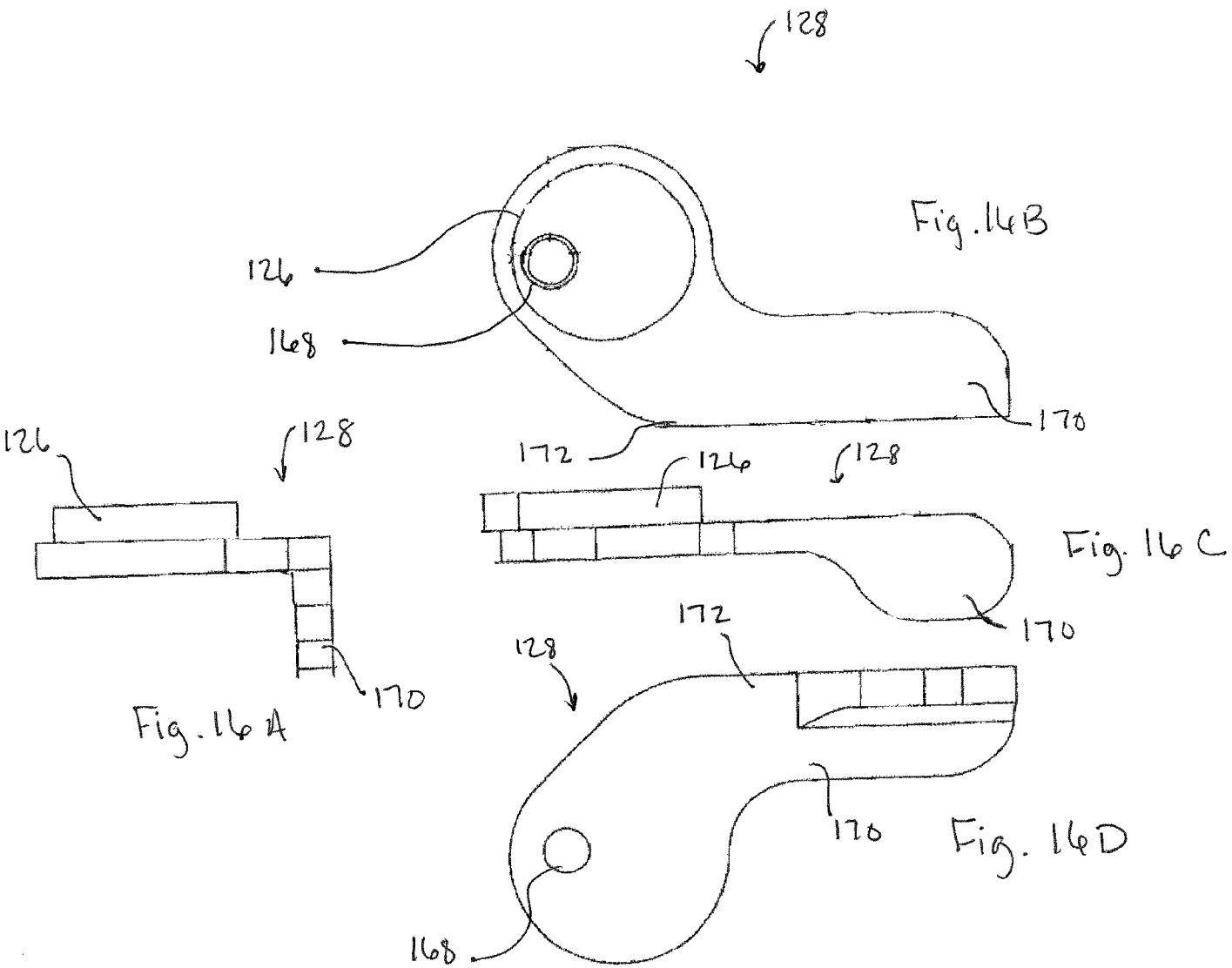

As outlined above, the paddle 104 can be coupled to the mount assembly 102 such that the paddle 104 is movable between a playing position and in a non-playing position. A handle 128 can be used to assist in fixing the position of the paddle 104 with respect to the mount assembly 102. FIGS. 15 A-B provide perspective views of an example handle 128. FIGS. 16 A-D provide top, bottom, and side views of the example handle 128. The handle can include a handle bore 168 sized and configured to engage a corresponding handle pin 124. The handle 128 can be rotatably coupled to the mount assembly 102 via the handle pin 124. The handle 128 can also include a grip portion 170. The grip portion 170 can be used to manipulate the rotational orientation of the handle 128. For example, the user can rotate the grip portion 170 and thereby cause a corresponding rotation of the handle 128 between a locked and unlocked position.

FIGS. 17-22 provide perspective views of an example apparatus 100 and a percussion instrument 200. As illustrated in FIGS. 17-20, the paddle 104 located in a playing position such that the playing surface 142 is located over the head 202 of the percussion instrument 200. FIGS. 21-22 provide the paddle 104 in a non-playing position such that the playing surface 142 is located away from the head 202 of the percussion instrument 200.

Figure 17:
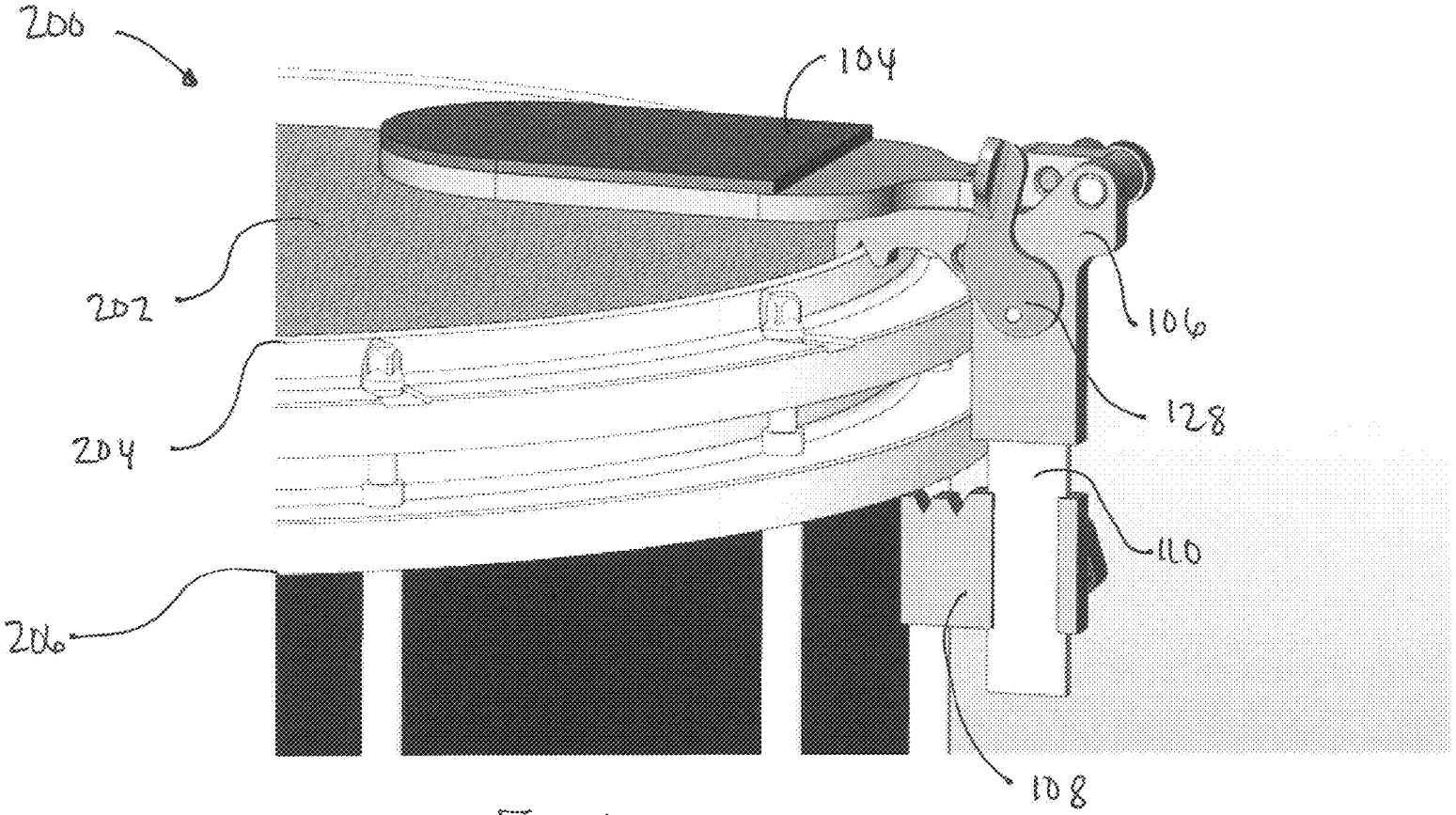
FIG. 17 is a perspective view of an example apparatus and percussion instrument.
Figure 18:
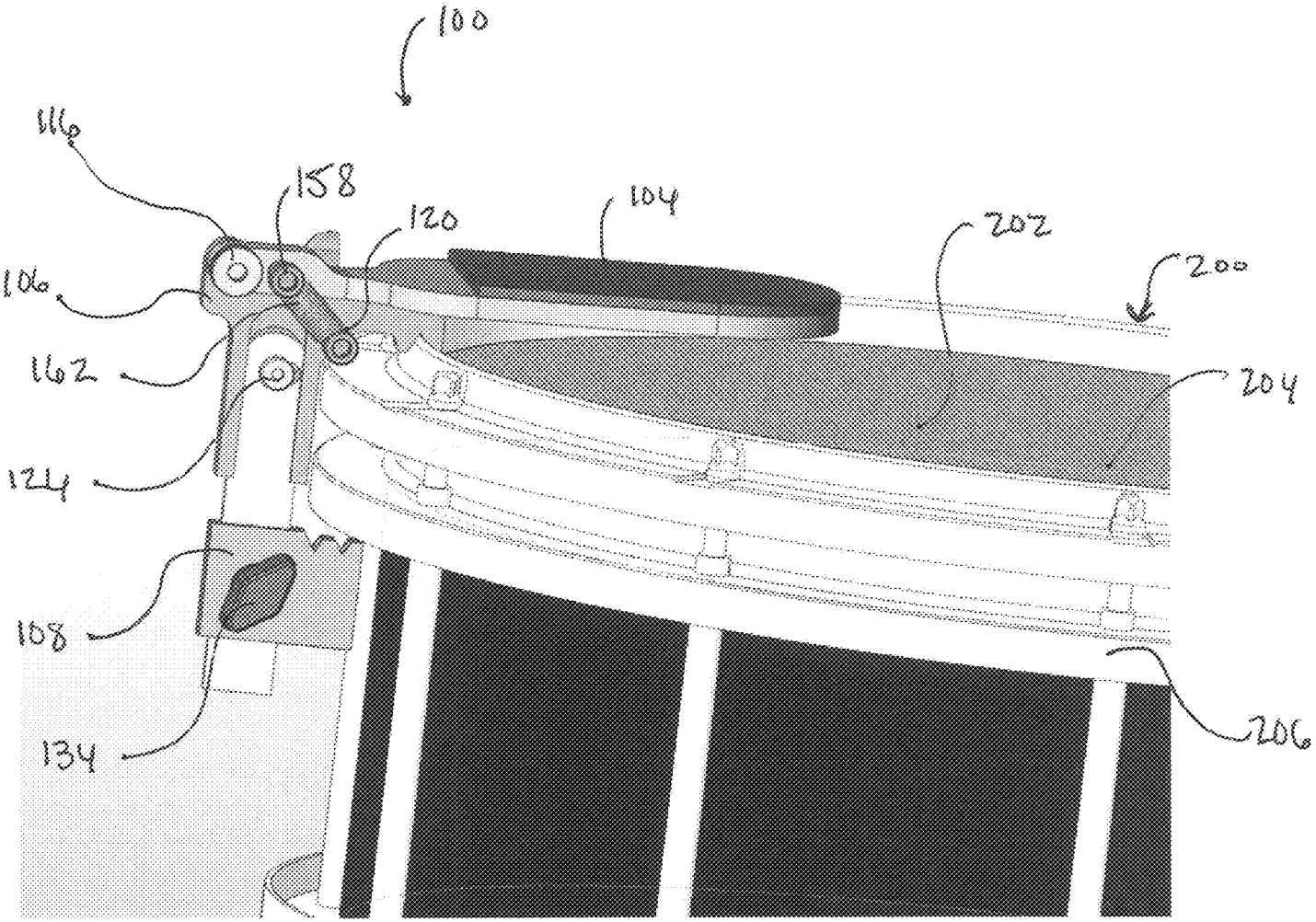
FIG. 18 is a perspective view of an example apparatus and percussion instrument.
Figure 19:
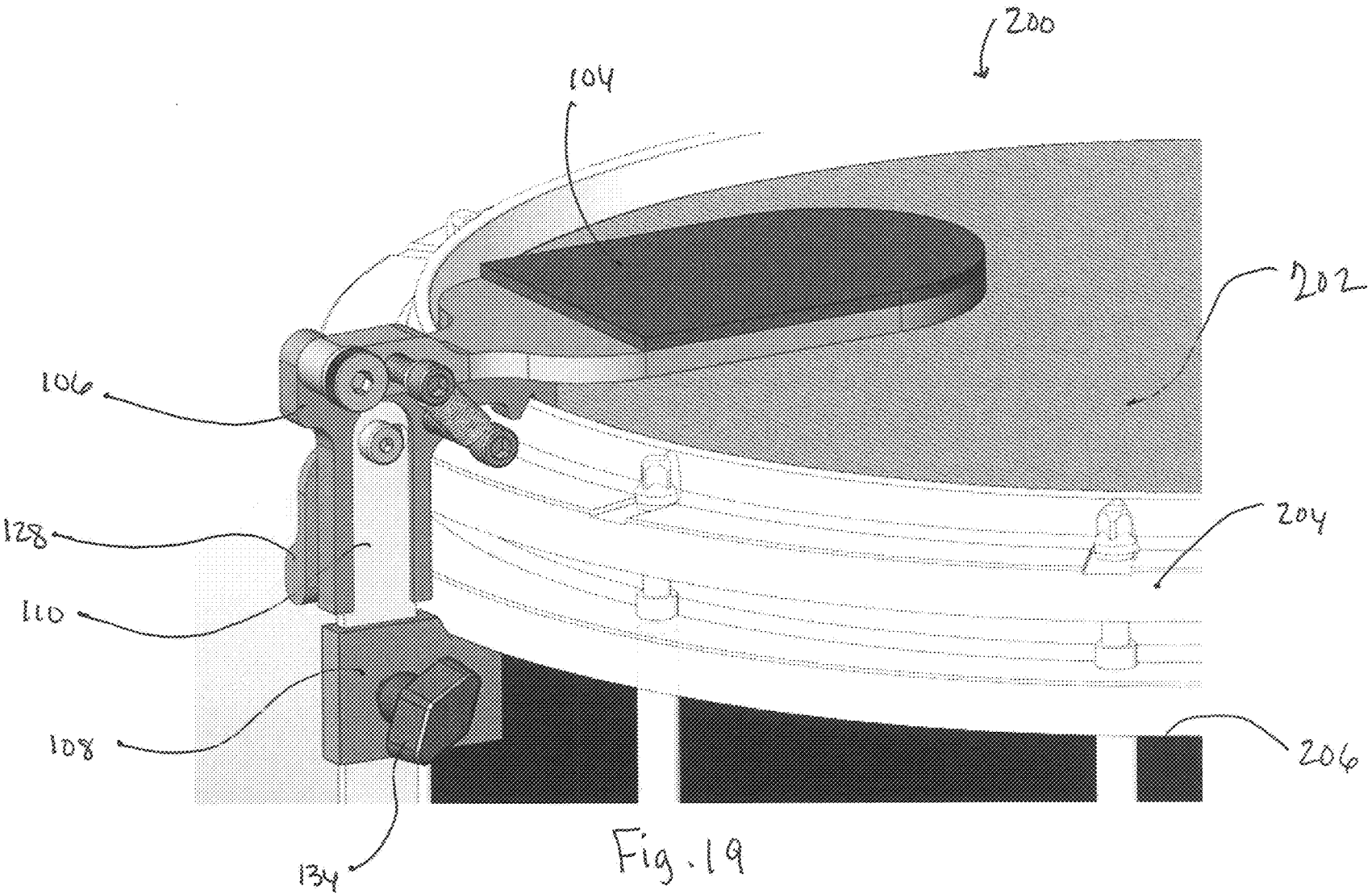
FIG. 19 is a perspective view of an example apparatus coupled to a percussion instrument.
Figure 20:
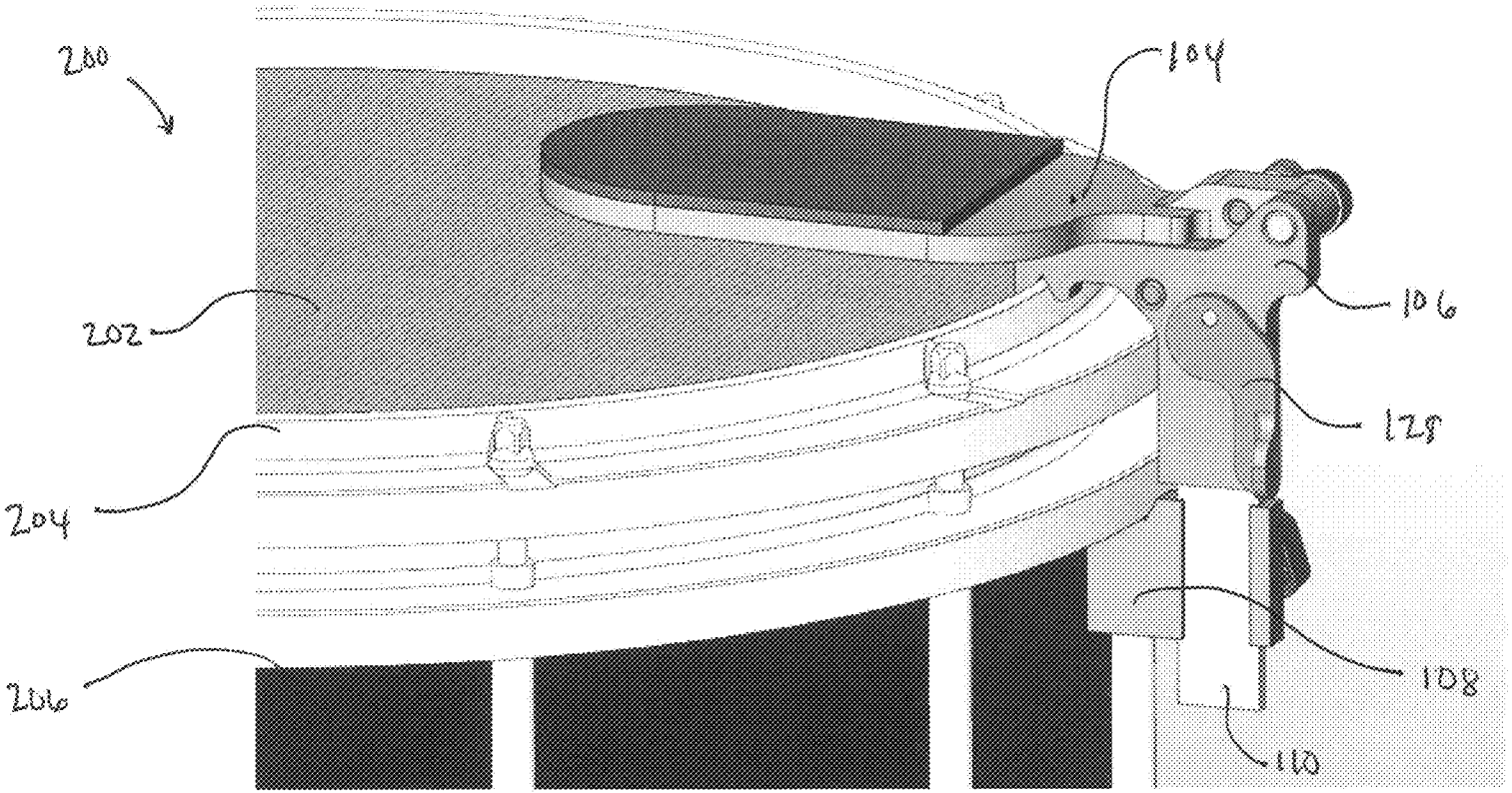
FIG. 20 is a perspective view of an example apparatus coupled to a percussion instrument.

As outlined above, the handle 128 can be coupled to the mount assembly 102 and movable between a locked and unlocked position for fixing a position of the paddle 104 between the playing and non-playing positions, respectively. FIGS. 17-18 illustrate the handle 128 in a locked position. The handle 128 can include a locking surface 172 sized and configured to engage, impact, or otherwise contact a corresponding locking surface 174 of the paddle 104. In the locked position, contact between the corresponding locking surfaces 172, 174 prevents rotation/movement of the paddle 104 with respect to the mount assembly 102. For example, when the handle 128 is in the locked position, the locking surfaces 172, 174 engage and prevent rotation of the paddle 104 from a playing position to a non-playing position. FIGS. 19-22 illustrate the handle 128 in the unlocked position. In the unlocked position, the handle 128 does not inhibit motion of the paddle 104 and the paddle 104 is free to rotate around the paddle pin 116.

The apparatus 100 can be coupled to the percussion instrument 200 as follows. As illustrated in FIGS. 17-18, the apparatus 100 is aligned with the percussion instrument 200 at the desired location. The upper clamp member 106 and the lower clamp member 108 can be aligned such that the upper engagement portion 112 and the lower engagement portion 130 align with a corresponding engagement portion of the percussion instrument 200. For example, the upper engagement portion 112 and the lower engagement portion 130 align with a corresponding edge/surface 204, 206 of the rim of the percussion instrument 200. During alignment, the paddle 104 can be in a playing position or a non-playing position. Once the apparatus 100 is aligned with the percussion instrument 200, the upper clamp member 106 and the lower clamp member 108 can be adjusted to engage the corresponding edge/surface 204, 206 of the rim of the percussion instrument 200. FIGS. 19-22 illustrate the mount assembly 102 coupled to the percussion instrument 200. The lower clamp member 108 can be adjusted along the draw bar 110 to provide sufficient contact/engagement between the upper clamp member 106 and the lower clamp member 108 and the percussion instrument 200. Once the mount assembly 102 is sufficiently engaged with the percussion instrument 200, the locking member 134 is adjusted to fix the position of the lower clamp member 108 with respect to the draw bar 110, thereby fixing the mount assembly 102 to the percussion instrument 200. To remove the apparatus 100, the locking member 134 may be released and the upper clamp member 106 and lower clamp member 108 separated along the draw bar 110. Once the upper engagement portion 112 and/or lower engagement portion 130 are released from the percussion instrument 200, the apparatus 100 maybe removed from the percussion instrument 200.

Figure 23:
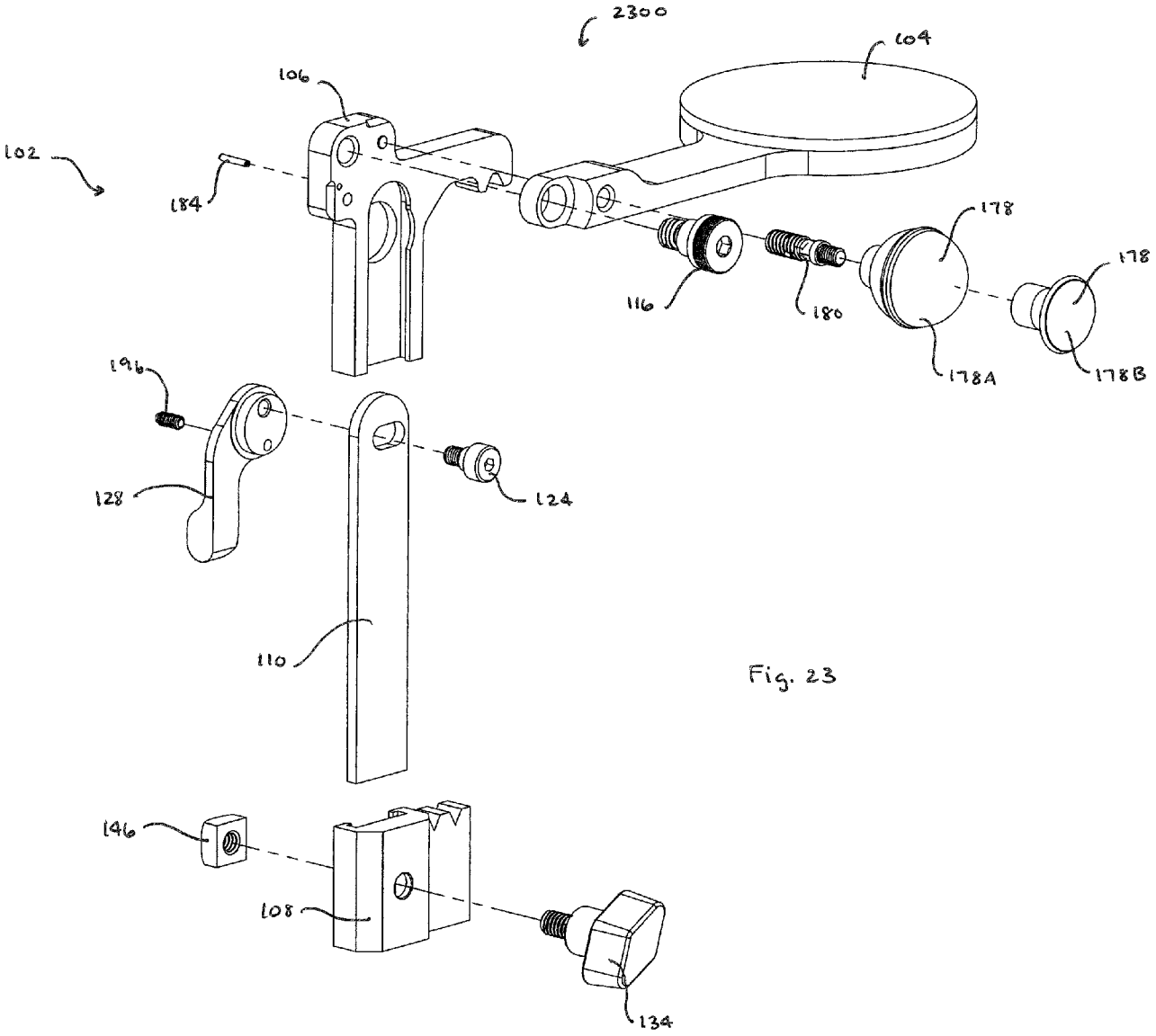
FIG. 23 is a perspective view of an example apparatus according to another embodiment.
Figure 24:
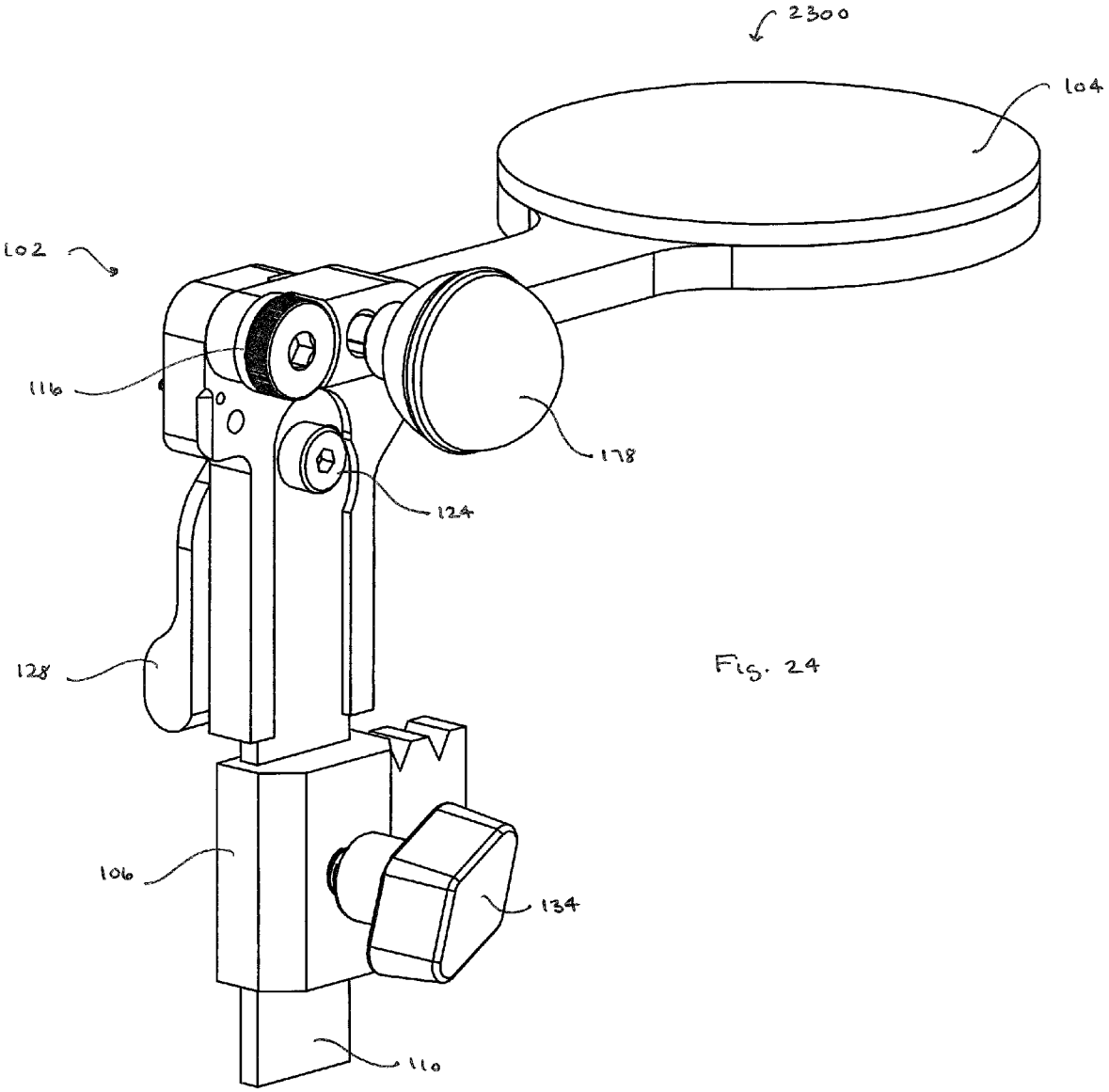
FIG. 24 is an exploded perspective view of the example apparatus of FIG. 23.

FIG. 23 provides a perspective view of an example apparatus 2300 according to another embodiment. The example apparatus 2300 illustrated in FIG. 23 includes some features similar to those included in the embodiment of FIG. 1. Where applicable, like reference numbers will be used to designate like features. FIG. 24 provides an exploded view of the example apparatus 2300 of FIG. 23.

The apparatus 2300 can include a mount assembly 102 and a paddle 104. The paddle 104 can be coupled to the mount assembly 102 such that the paddle 104 is movable between a playing position over the head 202 of the percussion instrument 200, illustrated in FIG. 17-20, and in a non-playing position away from the head 202 of the percussion instrument 200, illustrated in FIG. 21-22.

Figure 25:
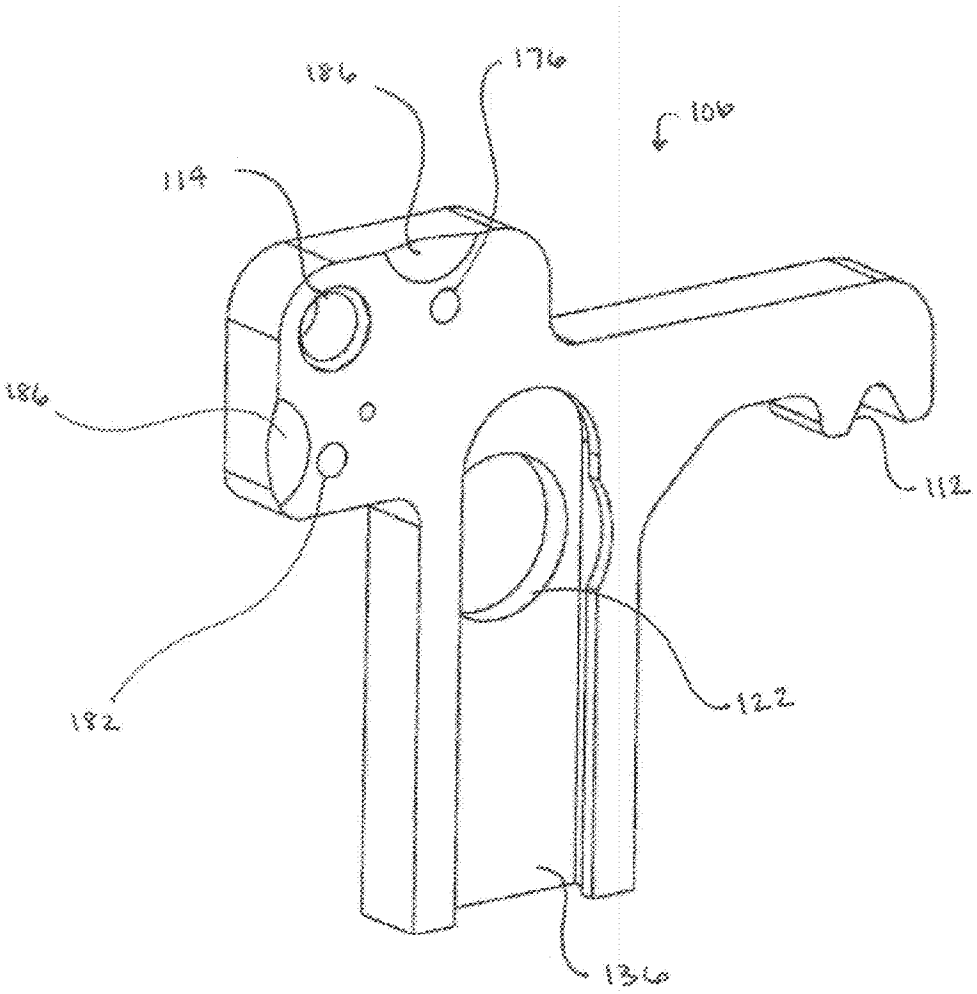
FIG. 25 is a perspective view of an upper clamp member.

The mount assembly 102 can include an upper clamp member 106, a lower clamp member 108, and a draw bar 110 coupled to the upper clamp member 106 and the lower clamp member 108 such that the spacing/distance between the upper clamp member 106 and the lower clamp member 108 can be adjusted. FIG. 25 provides a perspective view of the upper clamp member 106 of FIG. 23. FIGS. 26A-26C provide side and top views of the upper clamp member 106. As illustrated, the upper clamp member 106 can include an upper engagement portion 112 for engaging the percussion instrument 200. The upper engagement portion 112 can include a groove or recess sized and configured to engage a corresponding portion 204 of the percussion instrument 200. For example, the upper engagement portion 112 can include a recess sized and configured to engage an upper rim portion of the percussion instrument 200. The upper clamp member 106 can include a paddle pin bore 114 sized and configured to engage a corresponding paddle pin 116. The upper clamp member 106 can also include a handle bore 122 sized and configured to engage a corresponding handle pin 124 and/or rotation portion 126 of the handle 128. The upper clamp member 106 can also include a knob bore 176 sized and configured to engage a corresponding knob 178/knob pin 180. The upper clamp member 106 can also include a roll pin bore 182 sized and configured to engage a corresponding roll pin 184. The roll pin 184, when engaged, can limit rotation of the handle 128. For example, the roll pin 184 can prevent the handle 128 from rotating to a complete vertical position. The upper clamp member 106 can also include at least one recessed portion 186 on the outer surface of the upper clamp member 106.

The example apparatus 2300 can include a lower clamp member 108 similar to that illustrated in FIGS. 5A, 5B and 6A-D.

Figure 27A:
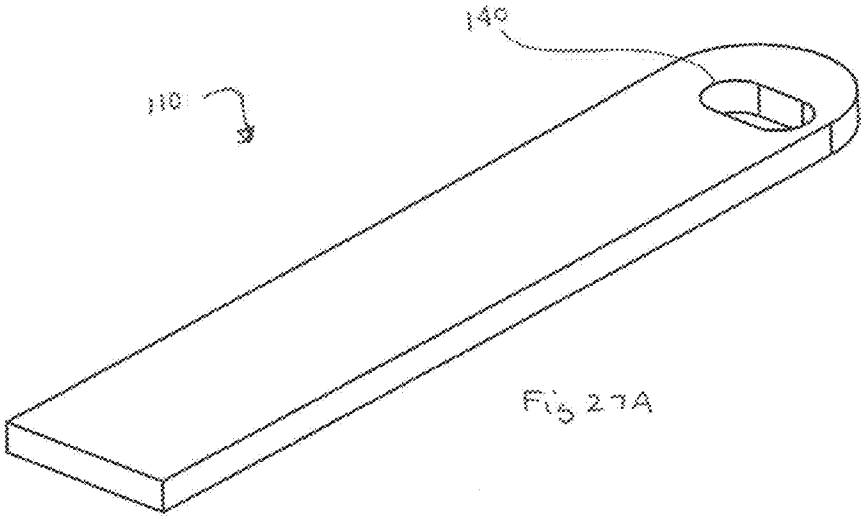
FIG. 27A is a perspective view of an example draw bar.
Figure 27B:
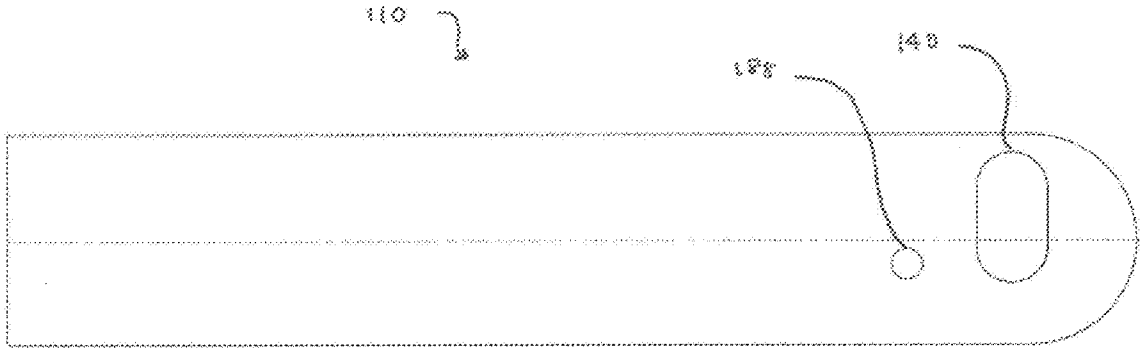
FIG. 27B is a bottom view of an example draw bar.
Figure 27C:
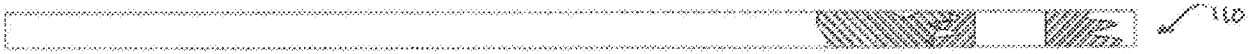
FIG. 27C is a side view of an example draw bar.
Figure 27D:
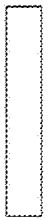
FIG. 27D is an end view of an example draw bar.

FIG. 27A provides a perspective view of an example draw bar 110. FIGS. 27B-D provide bottom, side and end views of the draw bar 110. As outlined above, the draw bar 110 can be movably coupled to the upper clamp member 106 and the lower clamp member 108 such that the spacing/distance between the upper clamp member 106 and the lower clamp member 108 can be adjusted along the draw bar 110. For example, as illustrated in FIGS. 5, 6, 25 and 26 the upper clamp member 106 and the lower clamp member 108 can include a recess 136 for receiving the draw bar 110. The draw bar 110 and the recess 136 can be sized and configured such that the draw bar 110 moves freely within the recess 136. As outlined above, the location of the draw bar 110 can be fixed with respect to the mount assembly 102 using a locking member 134. The draw bar 110 can also include a handle bore 140/slot sized and configured to engage a corresponding handle pin 124. As outlined above, the handle pin 124 can be used to mate the handle 128 and draw bar 110 with the upper clamp member 106. The draw bar 110 can also include a recess 188. The recess 188 can be sized and configured to engage a corresponding pin. When engaged the pin can provide stabilization to the draw bar 110. An engaged pin can also provide a preset for the handle pin 124. An example recess 188 can include a circular or semi-circular shaped recessed into the bottom surface of the draw bar 110.

As outlined above, a locking member 134, similar to the locking member 134 illustrated in FIGS. 8A and 8B, can be used to fix the position of the draw bar 110 with respect to at least one of the upper clamp member 106 and the lower clamp member 108.

Figure 28A:
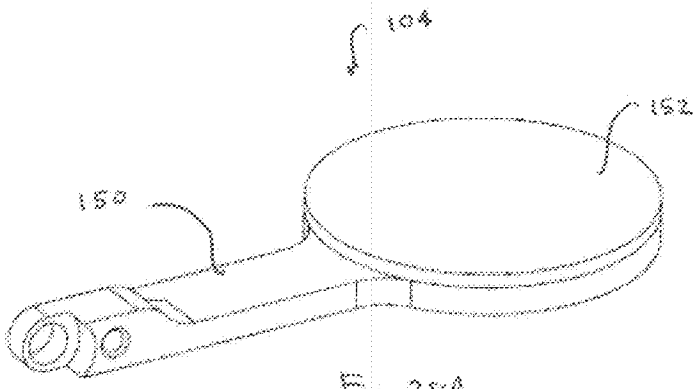
FIG. 28A is a perspective view of an example paddle.
Figure 28B:
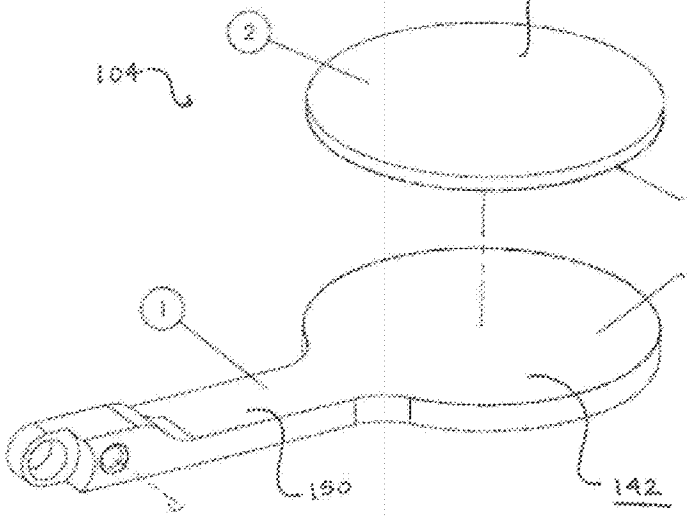
FIG. 28B is an exploded view of an example paddle.

As provided above, the apparatus 2300 can include a mount assembly 102 and a paddle 104. The paddle 104 can include a playing surface 142 and a paddle handle 150. FIG. 28A provides a perspective view of an example paddle 104. FIG. 28B provides an exploded view of the example paddle 104. A noise-dampening pad 152 can be affixed to at least a portion of the playing surface 142. FIGS. 29A-D provide top, side and end views of an example paddle 104. The paddle 104 can include a round playing surface 142 and an elongated handle 150 extending from the playing surface 142. Likewise, the noise-dampening pad 152 can define a round shape corresponding to the playing surface 142 of the paddle 104. The paddle handle 150 can include a paddle pin bore 154 sized and configured to engage a corresponding paddle pin 116. The paddle 104 can be pivotably coupled to the mount assembly 102 (at upper clamp member 106) at the paddle pin 116. The paddle 104 handle 150 can include a curved end surface 190 size and configured to accommodate the paddle pin 116. The paddle handle 150 can also include a knob bore 192 sized and configured to engage a corresponding knob 178/knob pin 180.

Figure 30A:
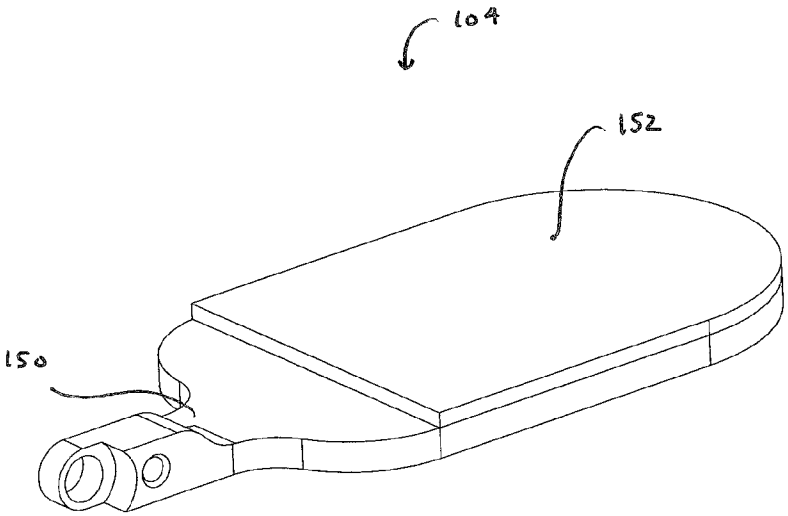
FIG. 30A is a perspective view of an example paddle.
Figure 30B:
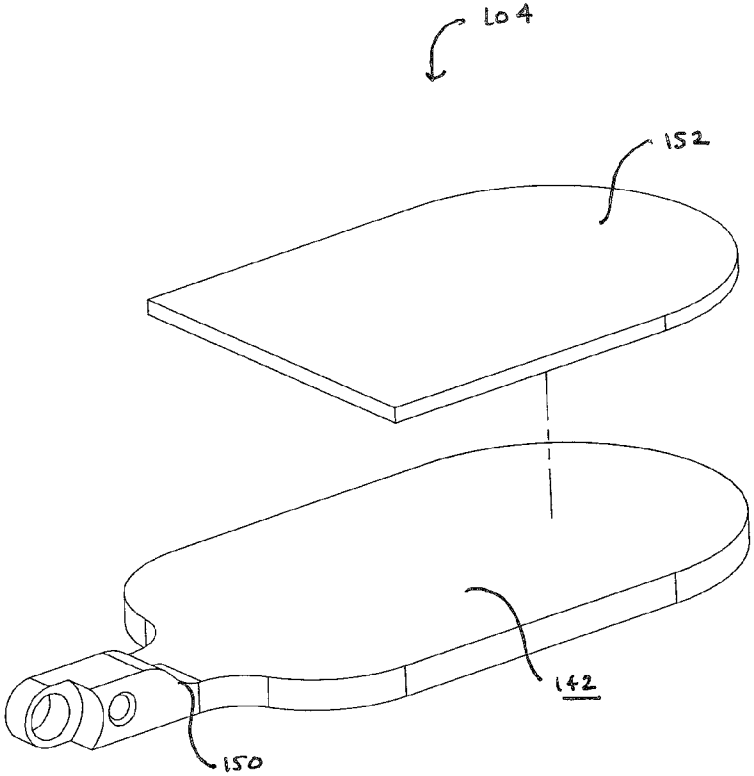
FIG. 30B is an exploded view of an example paddle.
Figures 31A, 31B, 31C:
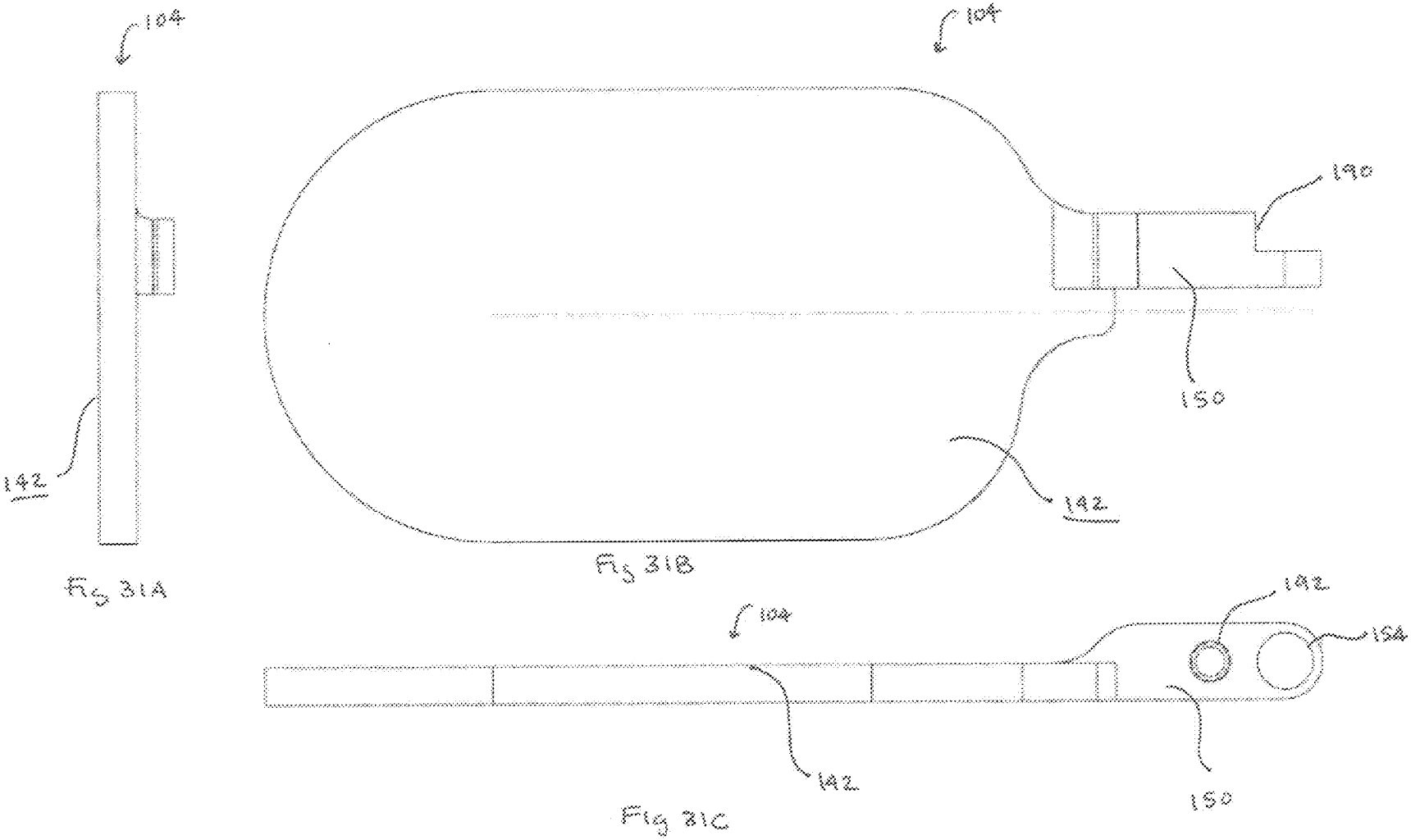
FIG. 31A is an end view of the example paddle of FIG. 30.
FIG. 31B is a top view of the example paddle of FIG. 30.
FIG. 31C is a side view of the example paddle of FIG. 30.

FIG. 30A provides a perspective view of another example paddle 104. FIG. 30B provides an exploded view of the other example paddle 104. FIGS. 31A-C provide end, top and side views of the example paddle 104. As illustrated in the figures, the playing surface 142 can define an elongated shape with rounded corners. Likewise, the noise-dampening pad 152 can define an elongated shape corresponding to the playing surface 142 of the paddle 104.

In an example apparatus 2300, the paddle 104 pivotably coupled to the mount assembly (e.g., upper clamp member 106) via the paddle pin 116. The location of the paddle 104 can be fixed with respect to the upper clamp member 106 using knob 178. When the knob 178 is engaged, the knob pin 180 can extend through the paddle handle 150 and through and/or into the upper clamp member 106. Thus engaged, the knob 178 fixes the location of the paddle 104 in a playing position over the head 202 of the percussion instrument 200. The knob 178 can be removed/disengaged, and the paddle 104 can rotate between a playing position and a non-playing position. As illustrated in FIGS. 23 and 24, the knob 178 includes a knob pin 180. The knob pin 180 can include an elongated shaft sized and configured to engage knob bores 176, 192. In another example, the knob pin 180 can include a retractable spring plunger. The grip portion/head of the knob 178 is coupled to the knob pin 180 and can include a threaded ball-shaped head 178A or a push-pull-lift phenolic knob 178B. FIG. 23 illustrated both a threaded ball knob 178A and a phenolic knob 178B. It is contemplated that the threaded ball knob 178A and phenolic knob 178B can be used as interchangeable options.

Figure 32A:
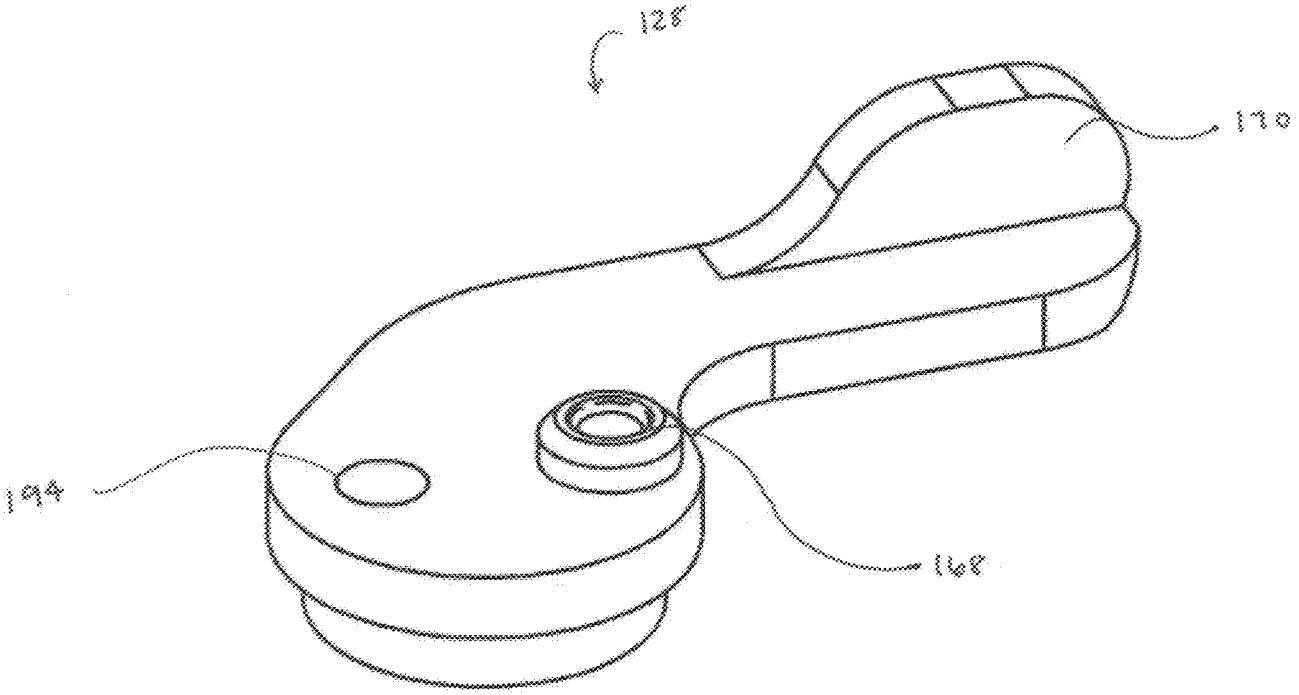
FIG. 32A is a perspective view of an example handle.
Figure 32C:
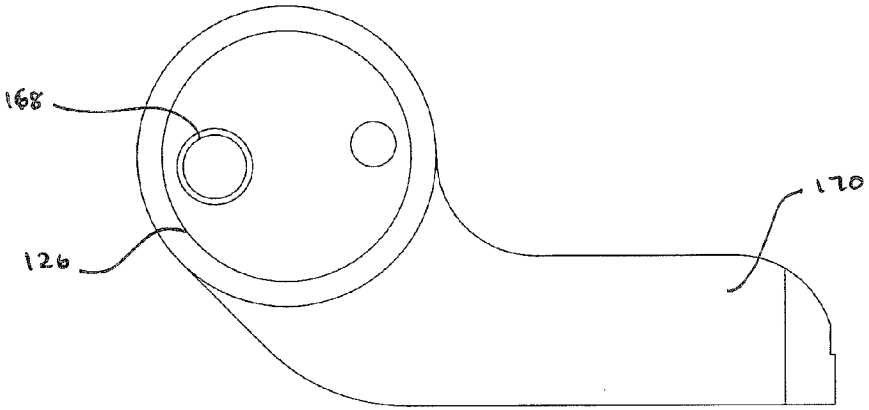
FIG. 32C is a top view of the example handle of FIG. 32A.
Figure 32D:
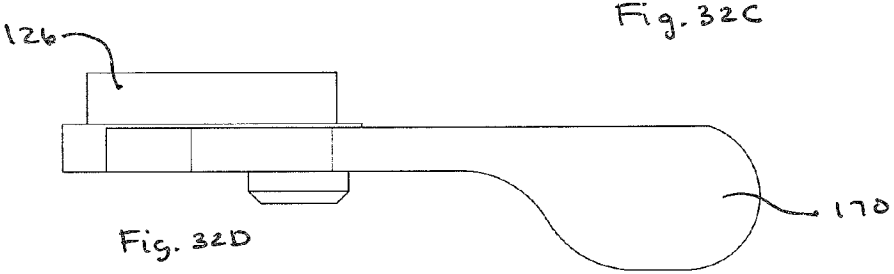
FIG. 32D is a side view of the example handle of FIG. 32A.
Figure 32E:
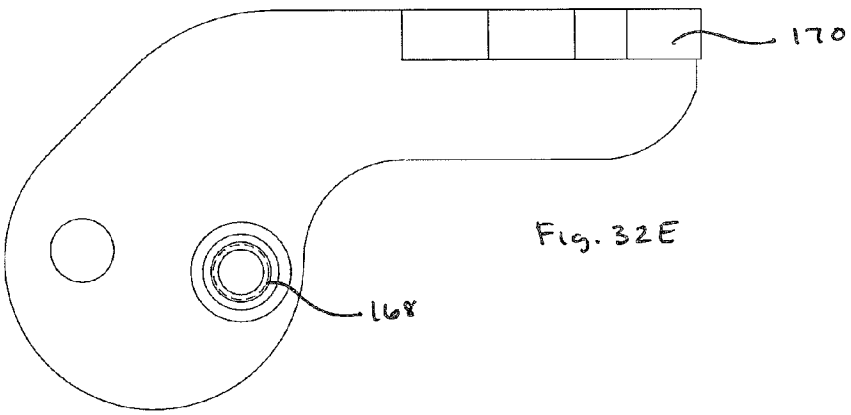
FIG. 32E is a bottom view of the example handle of FIG. 32A.
Figure 32B:
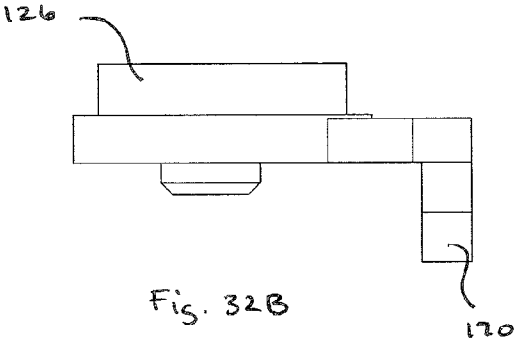
FIG. 32B is a end view of the example handle of FIG. 32A.

A handle 128 can be used to assist in fixing the position of the paddle 104 with respect to the mount assembly 102. FIG. 32A provides a perspective view of an example handle 128. FIGS. 32 B-E provide end, top, side and bottom views of the example handle 128. The handle can include a handle bore 168 sized and configured to engage a corresponding handle pin 124. The handle 128 can be rotatably coupled to the mount assembly 102 via the handle pin 124. The handle 128 can also include a grip portion 170. The grip portion 170 can be used to manipulate the rotational orientation of the handle 128. For example, the user can rotate the grip portion 170 and thereby cause a corresponding rotation of the handle 128 between a locked and unlocked position. The handle 128 can also include a rotation portion 126 sized and configured to engage the handle bore 122 of the upper clamp member 106. The rotation portion 126 can provide a rotation surface for the handle 128 with respect to the handle bore 1255/upper clamp member 106.

As outlined above, the handle 128 can be coupled to the mount assembly 102 and movable between a locked and unlocked position for fixing a position of the paddle 104 between the playing and non-playing positions, respectively. The handle 128 can include a locking surface 172 sized and configured to engage, impact, or otherwise contact a corresponding locking surface 174 of the paddle 104. In the locked position, contact between the corresponding locking surfaces 172, 174 prevents rotation/movement of the paddle 104 with respect to the mount assembly 102. The handle 128 can also include a draw bar pin bore 194 sized and configured to accommodate a draw bar pin 196. The draw bar pin 196 can be used to fix the location of the handle 128 with respect to the draw bar 110. An example draw bar pin 196 is a spring plunger (e.g., a ball nose spring plunger). The draw bar pin 196 can use used to lock the position of the handle 128, thereby fixing the paddle 104 in a playing/non-playing position.

Similar to the assembly illustrated in FIGS. 17-22, the apparatus 2300 can be coupled to the percussion instrument 200 and manipulated from a playing position to a non-playing position similar to the apparatus 100. The apparatus 2300 can be aligned with the percussion instrument 200 at the desired location and the upper clamp member 106 and the lower clamp member 108 positioned such that the upper engagement portion 112 and the lower engagement portion 130 align the percussion instrument 200 (e.g., edge/surface 204, 206 of the rim of the percussion instrument 200). Once the apparatus 2300 is aligned with the percussion instrument 200, the upper clamp member 106 and the lower clamp member 108 can be adjusted along the draw bar 110 to engage the edge/surface 204, 206 of the rim of the percussion instrument 200. Once the mount assembly 102 is in the desired position, the locking member 134 is adjusted to fix the position of the lower clamp member 108 with respect to the draw bar 110, thereby fixing the mount assembly 102 to the percussion instrument 200. The paddle is moved between a playing position and a non-playing position by adjustment of the knob 178 as outlined above. To remove the apparatus 100, the locking member 134 may be released and the upper clamp member 106 and lower clamp member 108 separated along the draw bar 110 and removed from the percussion instrument 200.

Figure 33:
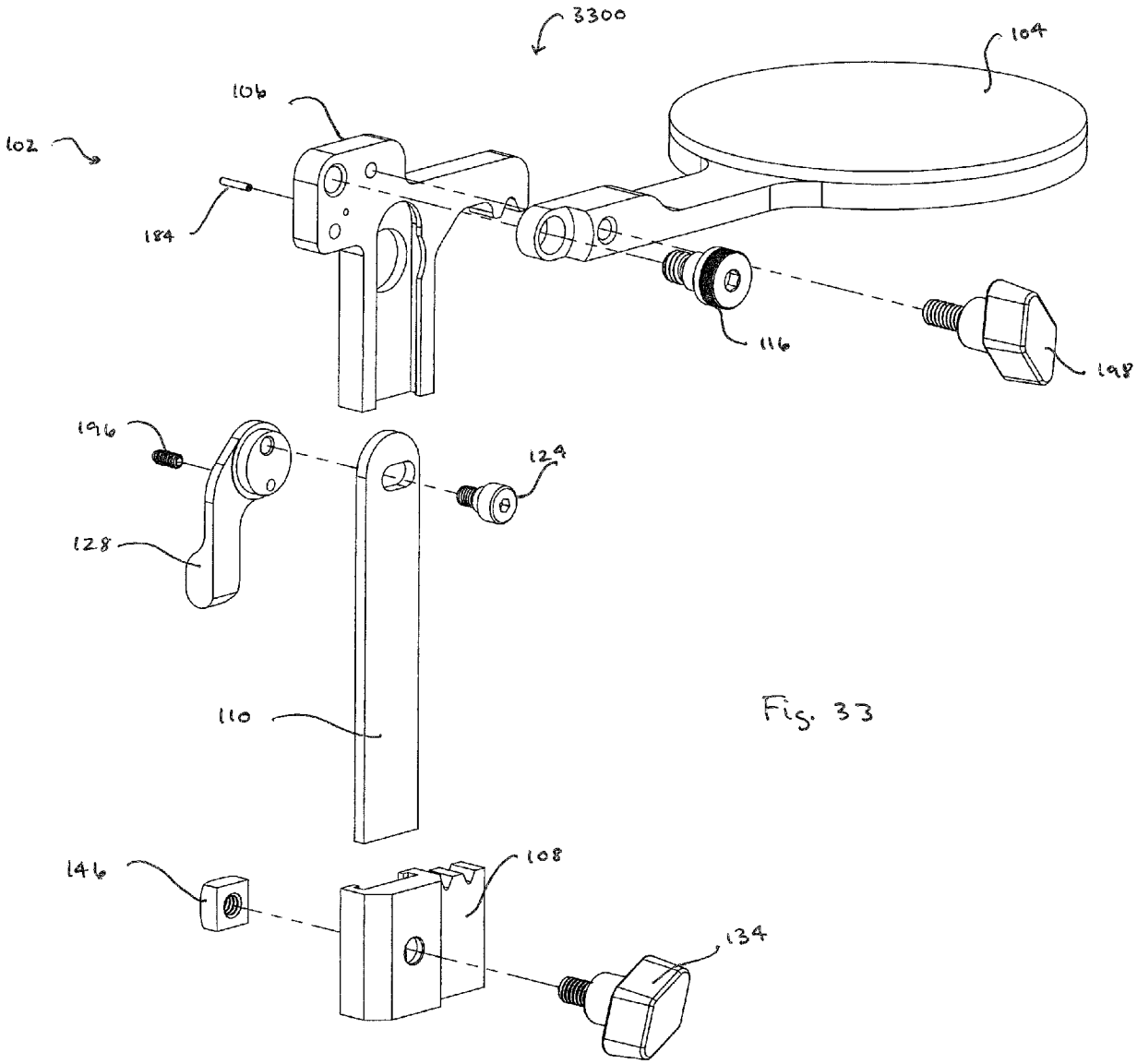
FIG. 33 is a perspective view of an example apparatus according to another embodiment.
Figure 34:
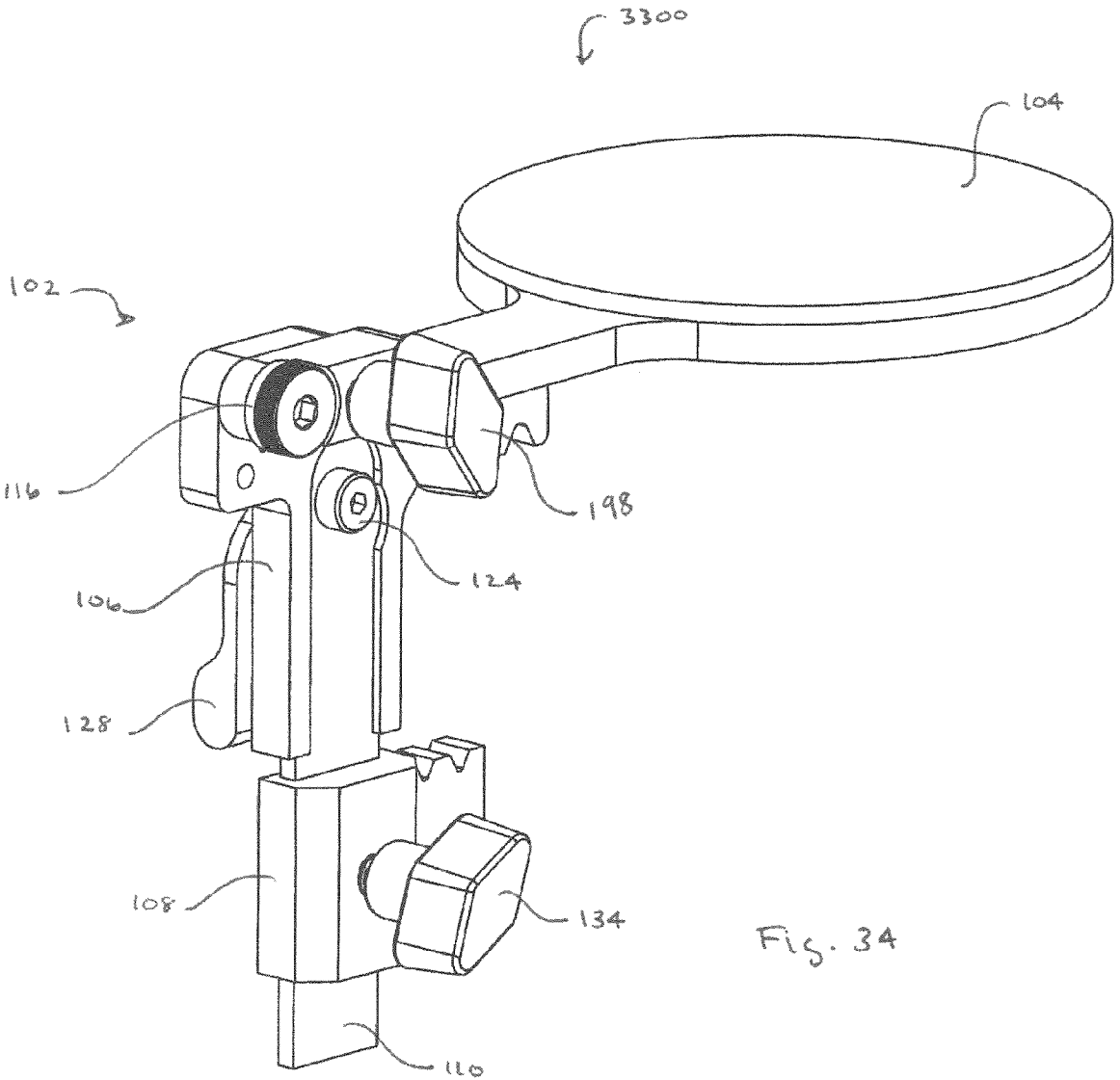
FIG. 34 is an exploded perspective view of the example apparatus of FIG. 33.

FIG. 33 provides a perspective view of an example apparatus 3300 according to another embodiment. The example apparatus 3300 illustrated in FIG. 33 includes features similar to those included in the embodiment of FIGS. 1 and 23. Where applicable, like reference numbers will be used to designate like features. FIG. 34 provides an exploded view of the example apparatus 3300 of FIG. 33.

The apparatus 3300 can include a mount assembly 102 and a paddle 104. The paddle 104 can be coupled to the mount assembly 102 such that the paddle 104 is movable between a playing position over the head 202 of the percussion instrument 200, illustrated in FIG. 17-20, and in a non-playing position away from the head 202 of the percussion instrument 200, illustrated in FIG. 21-22.

Figure 35:
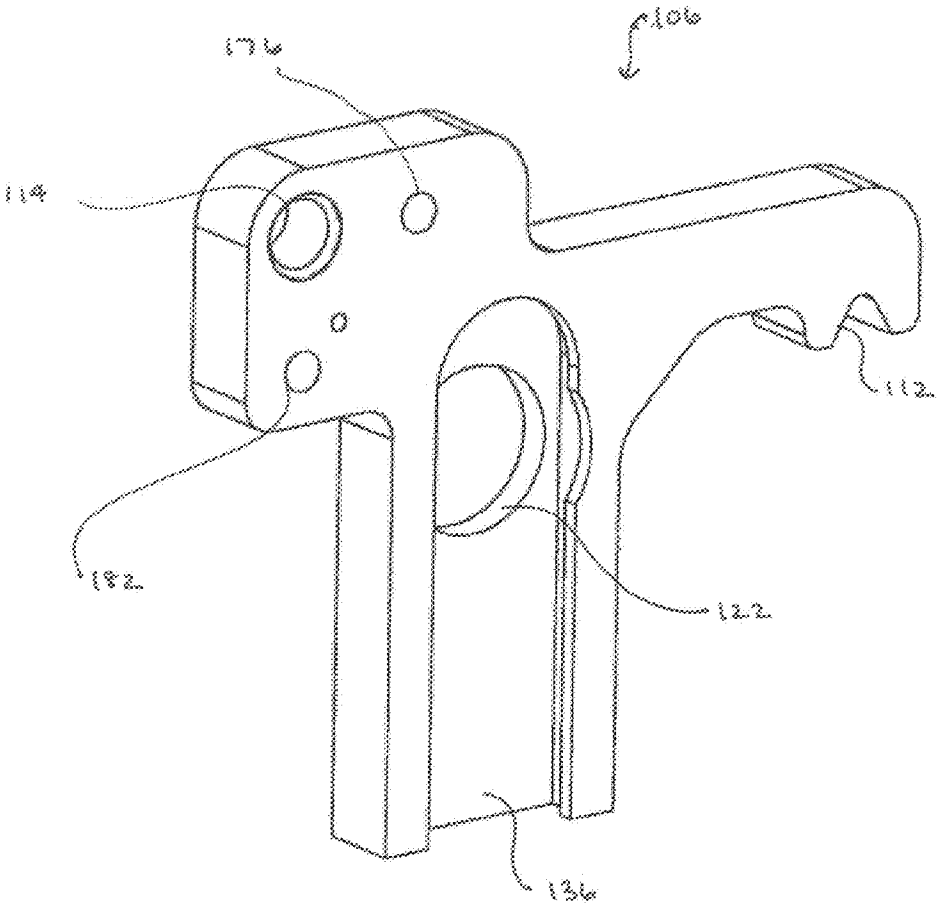
FIG. 35 is a perspective view of an upper clamp member.
Figure 36D:
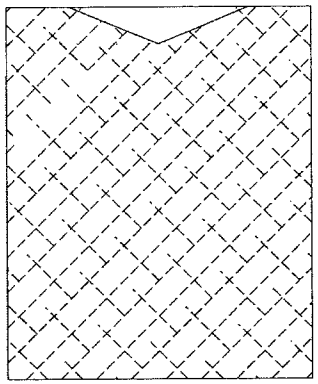
FIG. 36D is a partial section view of the example upper clamp member of FIG. 36.
Figure 36B:
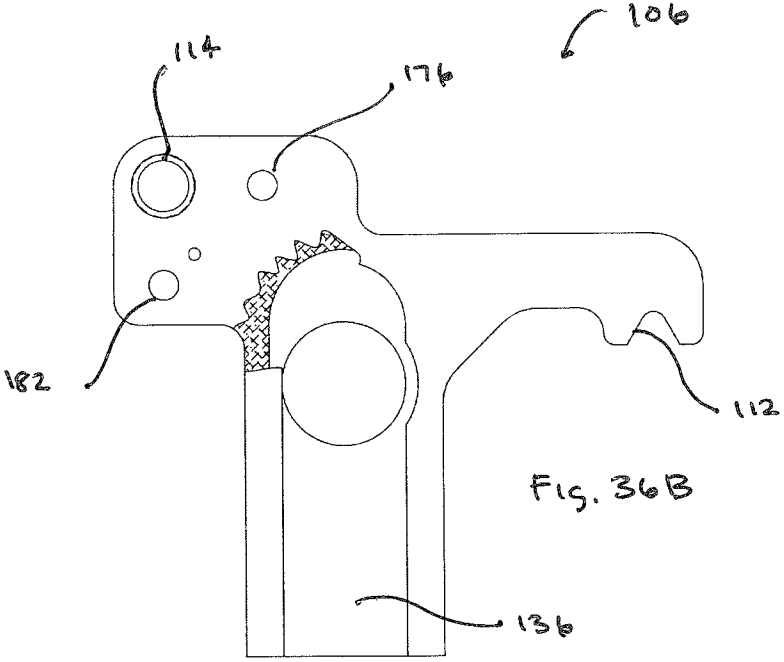
FIG. 36B is a front view of an example upper clamp member.
Figure 36C:
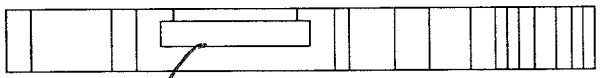
FIG. 36C is an end view of an example upper clamp member.
Figure 36A:
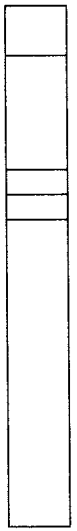
FIG. 36A is a side view of an example upper clamp member.

The mount assembly 102 can include an upper clamp member 106, a lower clamp member 108, and a draw bar 110 coupled to the upper clamp member 106 and the lower clamp member 108 such that the spacing/distance between the upper clamp member 106 and the lower clamp member 108 can be adjusted. FIG. 35 provides a perspective view of the upper clamp member 106 of FIG. 33. FIGS. 36A-36D provide side, top and section views of the upper clamp member 106. As illustrated, the upper clamp member 106 can include an upper engagement portion 112 for engaging the percussion instrument 200. The upper clamp member 106 can include a paddle pin bore 114 sized and configured to engage a corresponding paddle pin 116. The upper clamp member 106 can also include a handle bore 122 sized and configured to engage a corresponding handle pin 124 and/or rotation portion 126 of the handle 128. The upper clamp member 106 can also include a knob bore 176 sized and configured to engage a corresponding knob assembly 198. The knob bore 176 can extend through the upper clamp member 106. The knob bore 176 can extend into the body of the upper clamp member 106 a predetermined depth. The knob bore 176 can be sized and configured to engage the knob assembly 198 to fix the position/orientation of the paddle 106 with respect to the upper clamp member 106. FIG. 36D provides a section (A-A) view of an example knob bore 176 extending into the body of the upper clamp member 106 a certain depth. As illustrated in FIG. 36D, the knob bore 176 can include a "drill point" shaped recess. In another example, not shown, the knob bore 176 can define a recess having a round, square, or any other regular or irregular geometry. The upper clamp member 106 can also include a roll pin bore 182 sized and configured to engage a corresponding roll pin 184.

Figure 37B:
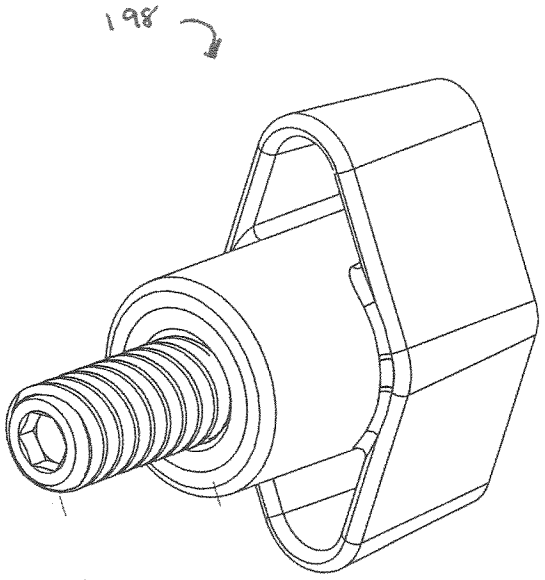
FIG. 37B is a perspective view of an example knob assembly.
Figure 37A:
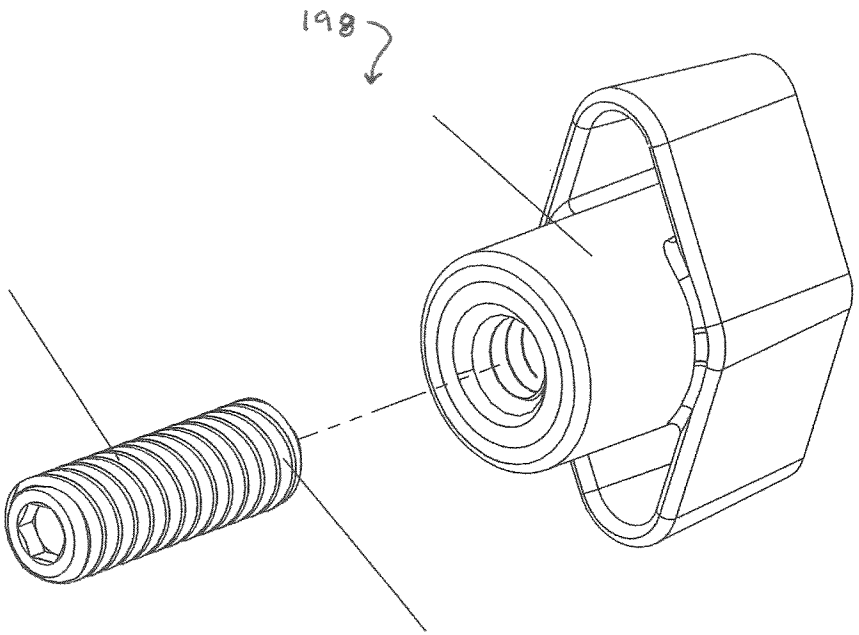
FIG. 37A is an exploded perspective view of an example knob assembly.

FIG. 37A provides an exploded view of an example knob assembly 198. FIG. 37B provides a perspective view of the example knob assembly 198. The knob assembly 198 can include an elongated shaft coupled to a head portion. The elongated shaft can include a threaded shaft, for example, a set screw. The knob assembly 198 can, for example, comprise a thumb screw. The distal end of the elongated shaft can include a coupling surface for engaging a corresponding surface of the knob bore 176. For example the coupling surface of the elongated shaft can include a rounded or oval-shaped tip. The coupling surface of the elongated shaft can define a round, square, or any other regular or irregular geometry corresponding and/or complimenting the knob bore 176.

The example apparatus 3300 can include a lower clamp member 108 similar to that illustrated in FIGS. 5A, 5B and 6A-D.

Figure 38A:
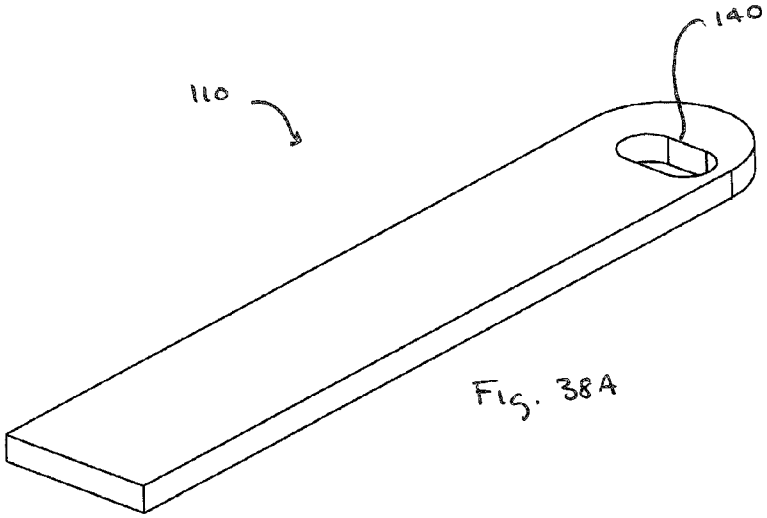
FIG. 38A is a perspective view of an example draw bar.
Figure 38B:
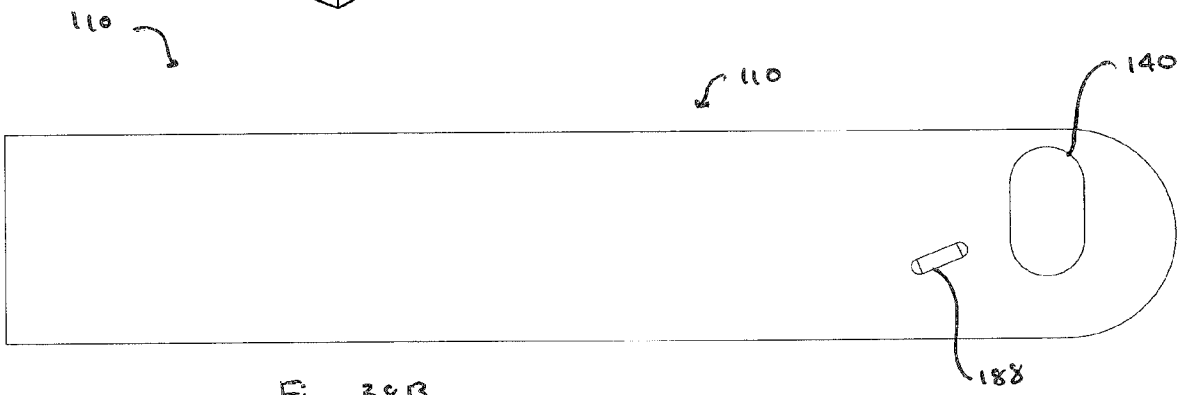
FIG. 38B is a bottom view of an example draw bar.
Figure 38C:
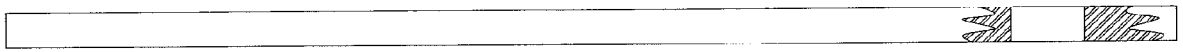
FIG. 38C is a side view of an example draw bar.
Figure 38D:
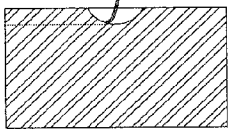
FIG. 38D is a partial section view of the example draw bar if FIG. 38.

FIG. 38A provides a perspective view of an example draw bar 110. FIGS. 38B-38D provide bottom, side and end views of the draw bar 110. As outlined above, the draw bar 110 can be movably coupled to the upper clamp member 106 and the lower clamp member 108 such that the spacing/distance between the upper clamp member 106 and the lower clamp member 108 can be adjusted along the draw bar 110. As outlined above, the location of the draw bar 110 can be fixed with respect to the mount assembly 102 using a locking member 134. The draw bar 110 can also include a handle bore 140/slot sized and configured to engage a corresponding handle pin 124. The draw bar 110 can also include a recess 188. An example recess 188 can include a circular or semi-circular shaped groove recessed into the bottom surface of the draw bar 110. FIG. 38D provides a section (A-A) view of the recess 188 extending into the body of the draw bar 110 a certain depth. As illustrated in FIG. 38D, the recess 188 can define a round or semi-circular shape. In another example, not shown, the recess 188 can define a "drill point", square, or any other regular or irregular geometry. As illustrated in FIG. 38B, the recess 188 can be offset from the centerline of the draw bar 110 a predetermined distance and angle.

As outlined above, a locking member 134, similar to the locking member 134 illustrated in FIGS. 8A and 8B, can be used to fix the position of the draw bar 110 with respect to at least one of the upper clamp member 106 and the lower clamp member 108.

As outlined above, the apparatus 3300 can include a paddle 104, as illustrated in FIGS. 9-14 and 28-31, that can be manipulated between a playing position and a non-playing position similar to the apparatus 100 and 2300. Once the apparatus 3300 is aligned with the percussion instrument 200, the upper clamp member 106 and the lower clamp member 108 can be adjusted along the draw bar 110 to engage the edge/surface 204, 206 of the rim of the percussion instrument 200 and the locking member 134 adjusted to fix the lower clamp member 108 with respect to the draw bar 110, fixing the mount assembly 102 to the percussion instrument 200. The paddle is moved between a playing position and a non-playing position by adjustment of the knob assembly 198. To remove the apparatus 100, the locking member 134 may be released and the upper clamp member 106 and lower clamp member 108 separated along the draw bar 110 and removed from the percussion instrument 200. While the foregoing description and drawings represent the preferred embodiment of the present invention, it will be understood that various additions, modifications, combinations and/or substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. In addition, features described herein may be used singularly or in combination with other features. The presently disclosed embodiments are, therefore, to be considered in all respects as illustrative and not restrictive, the scope of the invention being indicated by the appended claims and not limited to the foregoing description.

It will be appreciated by those skilled in the art that changes could be made to the embodiments described above without departing from the broad inventive concept thereof. For example, the apparatus 100 may be modified to adapt to various percussion instruments including, for example, a tenor drum, a bass drum, and a snare drum. It is understood, therefore, that this invention is not limited to the particular embodiments disclosed, but it is intended to cover modifications within the spirit and scope of the present invention, as defined by the following claims.

What is claimed is:

1. An apparatus providing a removable playing surface to a percussion instrument, the apparatus comprising:

a mount assembly for fixing the apparatus to the percussion instrument;

a paddle having a playing surface, the paddle coupled to the mount assembly such that the paddle is movable between a playing position over a head of the percussion instrument and in a non-playing position away from the head of the percussion instrument, and a handle coupled to the mount assembly movable between a locked and unlocked position for fixing a position of the paddle between the playing and non-playing positions, respectively.

2. The apparatus of claim 1, wherein the paddle further includes a noise-dampening pad affixed to at least a portion of the playing surface.

3. The apparatus of claim 2, wherein the noise-dampening pad is composed of rubber.

4. The apparatus of claim 1, wherein the paddle is pivotably coupled to the mount assembly at a paddle pin.

5. The apparatus of claim 1, further including a spring having a first end coupled to the paddle and a second end coupled to the mount assembly.

6. The apparatus of claim 5, wherein the paddle is spring loaded to default to a playing position.

7. The apparatus of claim 1, wherein the handle includes a locking surface sized and configured to impact a corresponding locking surface of the paddle when the handle is in a locked position.

8. The apparatus of claim 1, wherein the handle includes a grip portion.

9. The apparatus of claim 1, wherein the handle is rotatably coupled to the mount assembly at a handle pin.

10. The apparatus of claim 9, wherein the mount assembly includes a handle bore sized and configured to receive the handle pin.

11. The apparatus of claim 10, wherein the handle bore includes an elongated slot extending in a direction parallel to a playing surface of the percussion instrument.

12. The apparatus of claim 1, wherein the mount assembly further includes:

an upper clamp member having an upper engagement portion for engaging the percussion instrument;

a lower clamp member having a lower engagement portion for engaging the percussion instrument; and a draw bar moveably coupled to the upper clamp member and the lower clamp member such that the space between the upper clamp member and the lower clamp member can be adjusted.

13. The apparatus of claim 12, wherein the upper and lower clamp member include a recess sized and configured to receive the draw bar.

14. The apparatus of claim 12, further including a locking member for fixing the position of the draw bar with respect to at least one of the upper and lower clamp members.

15. The apparatus of claim 14, wherein the locking member is an elongated member extending through the draw bar and at least one of the upper and lower clamp members.

16. The apparatus of claim 15, further including a locking nut sized and configured to engage the elongated member and fix a position of the elongated member with respect to the draw bar and the at least one upper and lower clamp members.

17. The apparatus if claim 12, wherein the upper engagement portion includes a recess sized and configured to engage an upper rim portion of the percussion instrument.

18. The apparatus of claim 12, wherein the lower engagement portion includes a recess sized and configured to engage a lower rim portion of the percussion instrument.

19. The apparatus of claim 1, wherein the percussion instrument includes at least one of tenor drum, a bass drum, and a snare drum.

20. An apparatus providing a removable playing surface to a percussion instrument, the apparatus comprising:

a mount assembly for fixing the apparatus to the percussion instrument, the mount assembly including:

an upper clamp member having an upper engagement portion for engaging the percussion instrument;

a lower clamp member having a lower engagement portion for engaging the percussion instrument; and a draw bar moveably coupled to the upper clamp member and the lower clamp member such that the space between the upper clamp member and the lower clamp member can be adjusted; and a paddle having a playing surface, the paddle coupled to the mount assembly such that the paddle is movable between a playing position over a head of the percussion instrument and in a non-playing position away from the head of the percussion instrument.

* * * * *